US010910771B2

(12) United States Patent
Yokosawa et al.

(10) Patent No.: US 10,910,771 B2
(45) Date of Patent: Feb. 2, 2021

(54) CABLE FIXTURE AND ELECTRONIC DEVICE

(71) Applicant: FUJITSU LIMITED, Kawasaki (JP)

(72) Inventors: Takanaga Yokosawa, Kawasaki (JP); Takashi Watanabe, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 16/779,702

(22) Filed: Feb. 3, 2020

(65) Prior Publication Data

US 2020/0287327 A1 Sep. 10, 2020

(30) Foreign Application Priority Data

Mar. 5, 2019 (JP) ..... 2019-039453

(51) Int. Cl.
*H01R 13/639* (2006.01)

(52) U.S. Cl.
CPC ..... *H01R 13/6395* (2013.01)

(58) Field of Classification Search
CPC .. H01R 13/6395; H01R 13/639; H01R 13/60; H01R 13/62; H01R 13/58; H01R 13/5804; H01R 13/5812; H01R 13/5829; H01R 13/5845
See application file for complete search history.

(56) References Cited

U.S. PATENT DOCUMENTS 4,066,313 A * 1/1978 von dem Hagen .. H01R 13/639 439/471
4,618,200 A * 10/1986 Roberts ..... H01R 13/6395 439/147
4,652,069 A * 3/1987 Smith ..... H01R 13/6395 439/369
4,662,697 A * 5/1987 Moses ..... H01R 13/6395 174/67
5,044,976 A * 9/1991 Thompson ..... H01R 13/6395 439/368
5,782,648 A * 7/1998 Peterson ..... H01R 13/6392 24/16 PB
8,547,691 B2 * 10/2013 Peng ..... H01R 13/6395 361/679.4
9,867,304 B2 * 1/2018 Ritter ..... H01R 13/6395
2013/0183855 A1 * 7/2013 Warner ..... H01R 13/6395 439/536
2013/0217255 A1 * 8/2013 Gong ..... H01R 13/6395 439/351
2014/0009876 A1 * 1/2014 Wang ..... H01R 13/6395 361/679.01

(Continued)

FOREIGN PATENT DOCUMENTS

JP 2010-157458 A 7/2010
JP 2011-187334 A 9/2011

*Primary Examiner* — Harshad C Patel
(74) *Attorney, Agent, or Firm* — Fujitsu Patent Center

(57) ABSTRACT

A cable fixture including a first pressing member that includes a first plate portion facing a first outlet and a first connector of a first cable plugged into the first outlet, and a second plate portion bent from the first plate portion to one side in a facing direction between the first plate portion and the first outlet; and a supporting member configured to support the first pressing member and capable of fixing the second plate portion at a position where the first plate portion abuts on the first connector.

10 Claims, 24 Drawing Sheets

(56) References Cited

U.S. PATENT DOCUMENTS

| | | | | |
|---|---|---|---|---|
| 2014/0168883 | A1* | 6/2014 | Boswell | H01R 13/6395<br>361/679.43 |
| 2014/0308838 | A1* | 10/2014 | Kuo | H01R 13/629<br>439/347 |
| 2019/0044283 | A1* | 2/2019 | Cave | H01R 13/73 |

* cited by examiner

CABLE FIXTURE AND ELECTRONIC DEVICE

CROSS-REFERENCE TO RELATED APPLICATION

This application is based upon and claims the benefit of priority of the prior Japanese Patent Application No. 2019-39453, filed on Mar. 5, 2019, the entire contents of which are incorporated herein by reference.

FIELD

The embodiments discussed herein are related to a cable fixture and an electronic device.

BACKGROUND

There is a known technique to suppress a connector or plug of a cable connected to an outlet from falling off from the outlet, and also there is another known technique to keep connection with an outlet. For example, there is a known technique in which a mounting tool is provided around an inlet into which a plug of an alternating current (AC) cord is plugged, and the plug that has been plugged into the inlet and the mounting tool around the inlet are fixed by using a fixture locked to the mounting tool. Furthermore, there is another known technique in which a plate member is set on a rear surface of an attachment plug of a power cable connected to an outlet, the plate member is fixed to the outlet side by screwing, and the attachment plug is pressed to the outlet side. As the related art, for example, Japanese Laid-open Patent Publication No. 2011-187334, Japanese Laid-open Patent Publication No. 2010-157458, and the like are disclosed.

A cable having a connector of any size (a size or depth in a plug/unplug direction with respect to an outlet) may be connected to the outlet. In the related art, there may be a case where it is desirable to prepare a fixture for each cable in accordance with a size of a connector of the cable, and install the prepared fixture in order to connect and fix the connector of the cable to an outlet. Alternatively, there may be a case where it is desirable to employ a common fixture and limit a cable to be used is to those having connectors of the same size and fixable by the common fixture. Considering the above, it is desirable to provide a cable fixture by which a connector of any size may be fixed to an outlet.

SUMMARY

According to an aspect of the embodiments, a cable fixture including a first pressing member that includes a first plate portion facing a first outlet and a first connector of a first cable plugged into the first outlet, and a second plate portion bent from the first plate portion to one side in a facing direction between the first plate portion and the first outlet; and a supporting member configured to support the first pressing member and capable of fixing the second plate portion at a position where the first plate portion abuts on the first connector.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

First Embodiment

Figure 1:
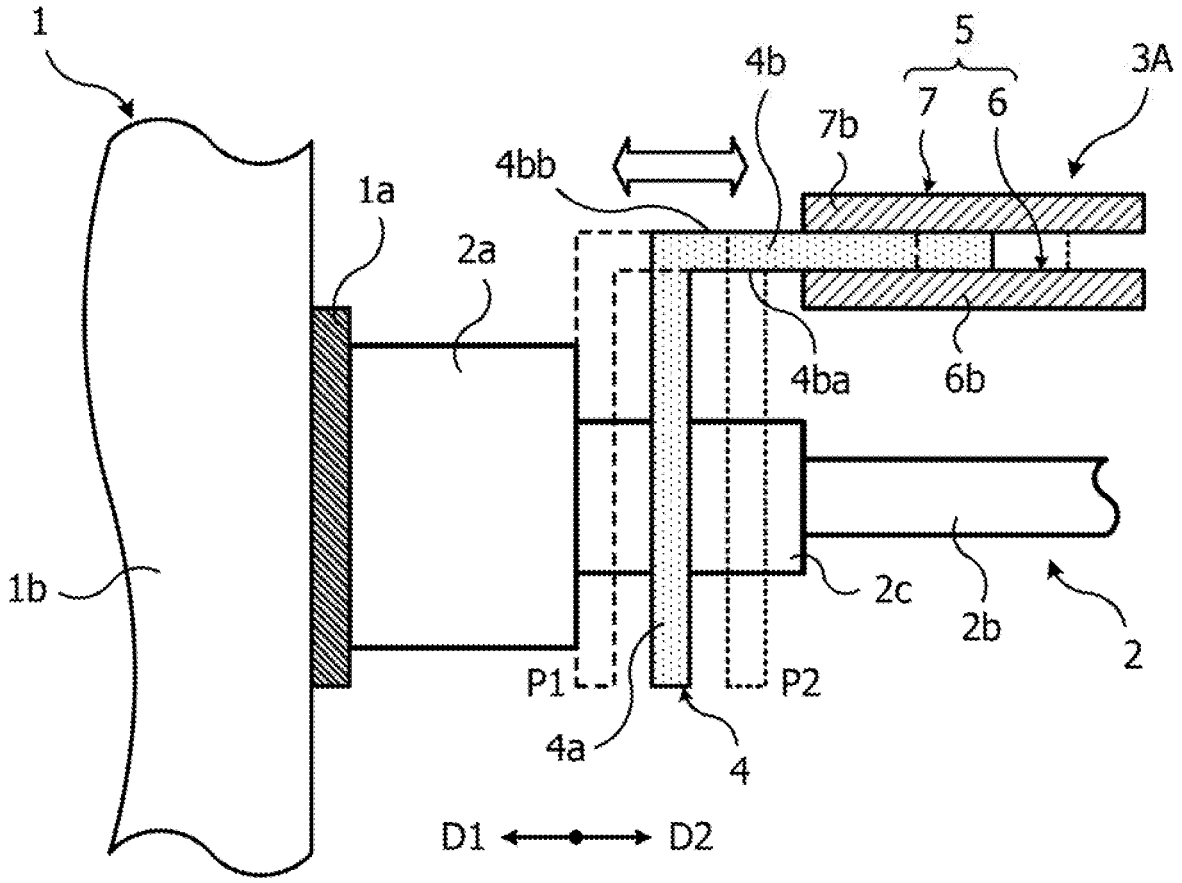
FIG. 1 is a diagram (part 1) illustrating a first exemplary cable fixture according to a first embodiment.
Figure 2A:
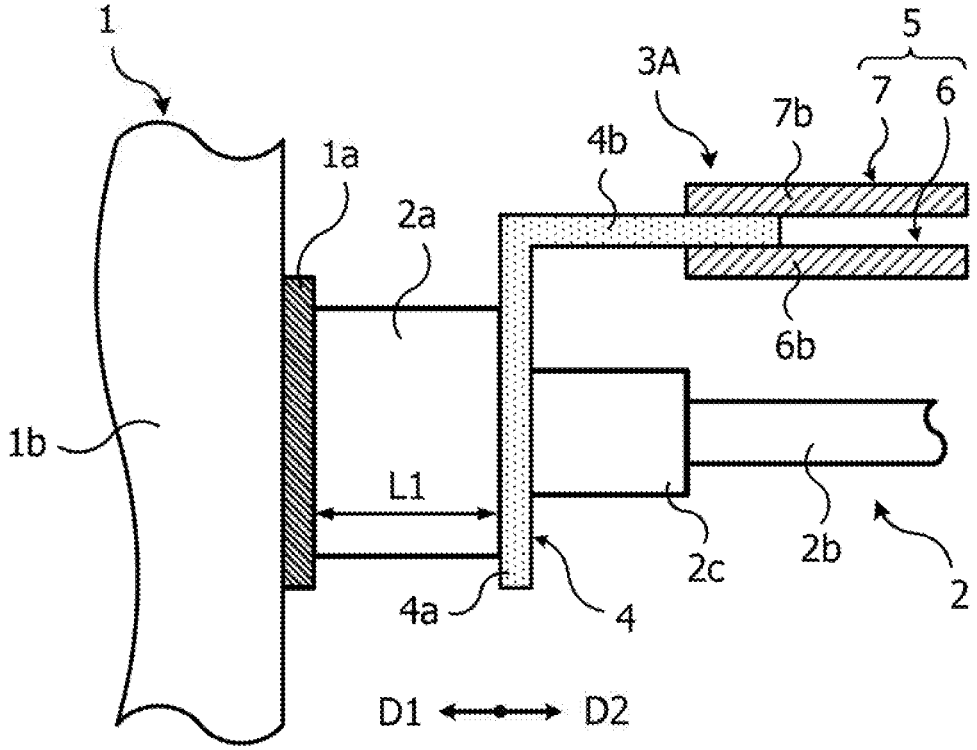
FIGS. 2A and 2B are diagrams (part 2) to describe the first exemplary cable fixture according to the first embodiment.
Figure 2B:
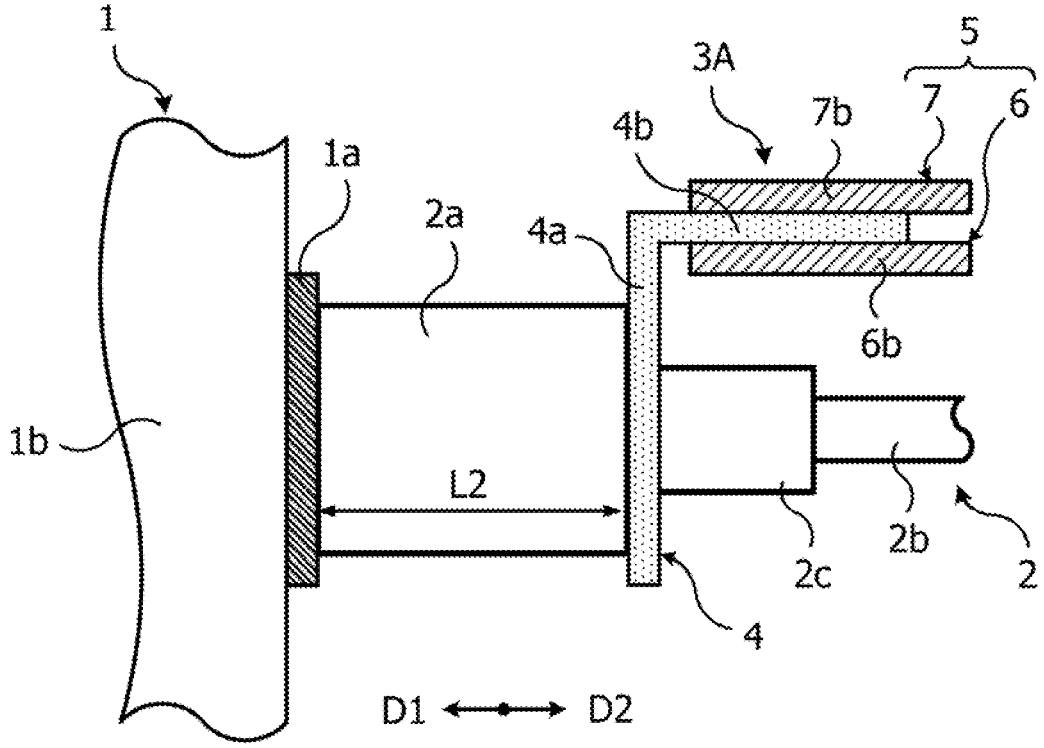

FIG. 1 and FIGS. 2A and 2B are diagrams to describe a first exemplary cable fixture according to a first embodiment. FIG. 1 and FIGS. 2A and 2B each schematically illustrate a side view of a main portion of the exemplary cable fixture.

As illustrated in FIG. 1, an electronic device 1 has a power cable 2 connected in order to supply power from another electronic device to the electronic device 1 or supply power from the electronic device 1 to another electronic device. The electronic device 1 includes a main body 1*b* and an outlet 1*a* provided in the main body 1*b*. The power cable 2 includes: an electric wire portion 2*b* having an electric wire covered; and a connector 2*a* provided at one end (root covered portion 2*c*) of the electric wire portion 2*b*. The power cable 2 is connected to the electronic device 1 when the connector 2*a* is plugged into the outlet 1*a* in a direction D1 approaching the outlet 1*a*. The power cable 2 is detached from the electronic device 1 when the connector 2*a* currently plugged into the outlet 1*a* is pulled out from the outlet 1*a* in a direction D2 away from the outlet 1*a*.

The electronic device 1 having the power cable 2 connected is provided with a cable fixture 3A as illustrated in FIG. 1, for example. The cable fixture 3A includes a pressing member 4 and a supporting member 5 that supports the pressing member 4.

The pressing member 4 includes: a plate portion 4*a* (an example of a first plate portion) facing the outlet 1*a* and the connector 2*a* plugged into the outlet 1*a*; and a plate portion 4*b* (an example of a second plate portion) bent from the plate portion 4*a*. In FIG. 1, the example is provided for the plate portion 4*b* that is bent in the direction D2 from an end of the plate portion 4*a* facing the outlet 1*a* and the connector 2*a*, and extends in the direction D2. As described later, in the pressing member 4, the plate portion 4*a* facing the outlet 1*a* and the connector 2*a* is made to abut on the connector 2*a*, and the plate portion 4*b* bent from the plate portion 4*a* is fixed at the abutment position. Thus, the pressing member 4 functions to suppress the connector 2*a* from coming off from the outlet 1*a*.

For the pressing member 4, various kinds of materials having predetermined rigidity are used, and in a state where the plate portion 4*a* is made to abut on the connector 2*a* and the plate portion 4*b* is fixed at the abutment position as described above, the various kinds of materials may suppress the connector 2*a* from coming off from the outlet 1*a*. For example, a resin material is used for the pressing member 4. Besides, for the pressing member 4, a metal material, a ceramic material, a carbon material, or a composite material including fibers or cloth of a carbon material and a glass material, and a resin material may be used.

For the pressing member 4, one kind of material may be used, or two or more kinds of materials may be used. For the pressing member 4, for example, the same kind of material may be used for the plate portion 4*a* and the plate portion 4*b*, or different kinds of materials may be used for the plate portion 4*a* and the plate portion 4*b*. For the pressing member 4, a single-layer plate using one kind of material or a laminated plate using one kind of material or two or more kinds of materials may also be used. The pressing member 4 may not be desired to have an entirely uniform thickness. For example, the plate portion 4*a* and the plate portion 4*b* of the pressing member 4 may have the same thickness, or the plate portion 4*a* and the plate portion 4*b* may have different thicknesses. The rigidity of the pressing member 4 or rigidity of the plate portion 4*a* and plate portion 4*b* may be adjusted in accordance with the kind of material and the thickness of the pressing member 4 or the kinds of materials and the thicknesses of the plate portion 4*a* and the plate portion 4*b*.

The supporting member 5 is provided at a fixed position with respect to the outlet 1*a* of the electronic device 1, and supports the pressing member 4. The supporting member 5 includes a supporting tool 6 and a supporting tool 7 which sandwich the plate portion 4*b* of the pressing member 4 from both sides of the supporting member 5. The supporting tool 6 includes a plate portion 6*b* (an example of a third plate portion) facing one surface 4*ba* of the plate portion 4*b* of the pressing member 4. The supporting tool 7 includes a plate portion 7*b* (an example of a fifth plate portion) facing the other surface 4*bb* of the plate portion 4*b* of the pressing member 4. The plate portion 4*b* of the pressing member 4 is sandwiched between the plate portion 6*b* of the supporting tool 6 and the plate portion 7*b* of the supporting tool 7.

The supporting member 5 may fix the plate portion 4*b* of the pressing member 4 in a state where the plate portion 4*b* of the pressing member 4 is sandwiched between the plate portion 6*b* of the supporting tool 6 and the plate portion 7*b* of the supporting tool 7. For example, the plate portion 6*b* of the supporting tool 6 and the plate portion 7*b* of the supporting tool 7 are fixed by screwing or the like while sandwiching the plate portion 4*b* of the pressing member 4 therebetween. Thus, the sandwiched plate portion 4*b* is fixed, and the pressing member 4 is fixed. Before fixing the plate portion 4*b*, the plate portion 4*b* of the pressing member 4 is slidable in the directions D1 and D2 (facing direction between the plate portion 4*a* of the pressing member 4, the connector 2*a*, and the outlet 1*a*) along the plate portion 6*b* of the supporting tool 6 or the plate portion 7*b* of the supporting tool 7, or along these plate portions while the plate portion 4*b* is sandwiched between these plate portions.

For the supporting tools 6 and 7, various kinds of materials capable of supporting the pressing member 4 and having predetermined rigidity are used. For example, a metal material is used for the supporting tools 6 and 7. Besides, for the supporting tools 6 and 7, a metal material, a ceramic material, a carbon material, or a composite material including fibers or cloth of a carbon material and a glass material, and a resin material may also be used.

For each of the supporting tools 6 and 7, one kind of material may be used or two or more kinds of materials may be used. For example, a single-layer plate using one kind of material or a laminated plate using one kind of material or two or more kinds of materials may also be used for the supporting tool 6. For the supporting tool 7, a single-layer plate using one kind of material or a laminated plate using one kind of material or two or more kinds of materials may be used. The rigidity of each of the supporting tools 6 and 7 may be adjusted in accordance with the kind of material and the thicknesses of each of the supporting tools 6 and 7. When the plate portion 4*b* of the pressing member 4 is slid along the plate portion 6*b* or the plate portion 7*b* or along both of the plate portions facing the plate portion 4*b* of the pressing member 4, frictional force may be adjusted in accordance with the kind of material of the supporting tool 6 or the supporting tool 7 or the kinds of materials of both of the supporting tools (at least surface materials of these supporting tools).

In the cable fixture 3A, the plate portion 4*b* of the pressing member 4 is slid in the directions D1 and D2 along the plate portion 6*b* of the supporting tool 6 or the plate portion 7*b* of the supporting tool 7 or along both of these plate portions, thereby changing a position of the plate portion 4*a* of the pressing member 4 facing the connector 2*a*. As a result, a distance between the connector 2*a* and the plate portion 4*a* of the pressing member 4 is changed. In FIG. 1, such displacement of the pressing member 4 by the sliding of the plate portion 4*b* is indicated by a thick arrow. Here, in FIG. 1, a state when the pressing member 4 (represented by a solid line) at a certain position is slid in the direction D1 is indicated by a chain line P1, and a state when the pressing member 4 is slid in the direction D2 is indicated by a dotted line P2, respectively. For example, the plate portion 4*b* of the pressing member 4 is slid such that the plate portion 4*a* abuts on the connector 2*a* (the electric wire portion 2*b* or a stepped portion from the root covered portion 2*c* of the electric wire portion 2*b*) of the power cable 2. Then, the plate portion 4*b* is fixed at the abutment position (in the state indicated by the chain line P1) by the plate portion 6*b* of the supporting tool 6 and the plate portion 7*b* of the supporting tool 7 which sandwich the plate portion 4*b*.

In the cable fixture 3A, the plate portion 6*b* of the supporting tool 6 and the plate portion 7*b* of the supporting tool 7 in the supporting member 5 are provided at fixed positions with respect to the outlet 1*a* of the electronic device 1. The plate portion 4*b* of the pressing member 4 is slid along such a supporting member 5, and then fixed. Thus, the plate portion 4*a* of the pressing member 4 is fixed at the position where the plate portion 4*a* of the pressing member 4 abuts on the connector 2*a* of the power cable 2. The connector 2*a* is pressed in the direction D1 by the plate portion 4*a* of the pressing member 4 that is fixed by the abutment on the connector 2*a*, and the movement of the connector 2*a* in the direction D2 is restricted. Thus, the connector 2*a* is suppressed from coming off from the outlet 1*a*. As a result, power failure caused by the connector 2*a* coming off from the outlet 1*a* is suppressed.

As described above, the cable fixture 3A has the mechanism in which the pressing member 4 is displaced and fixed by using the supporting tools 6 and 7. Therefore, as illustrated in FIGS. 2A and 2B, even when a size L1 or L2 (the size in the directions D1 and D2) of the connector 2*a* to be plugged into the outlet 1*a* is changed, the position of the pressing member 4 is adjusted in accordance with the size L1 or L2, and the plate portion 4*a* of the pressing member 4 may be made to abut on the connector 2*a*. As a result, the connector 2*a* having the size L1 or the size L2 is pressed by the pressing member 4, and the connector 2*a* having any of these sizes may be suppressed from coming off from the outlet 1*a*. According to the cable fixture 3A, the connector 2*a* of any size that is to be plugged into the outlet 1*a* is pressed to the outlet 1*a* side, and it may be possible to suppress the connector 2*a* from coming off from the outlet 1*a* and reduce the power failure caused by the coming-off of the connector 2*a*.

Figure 3:
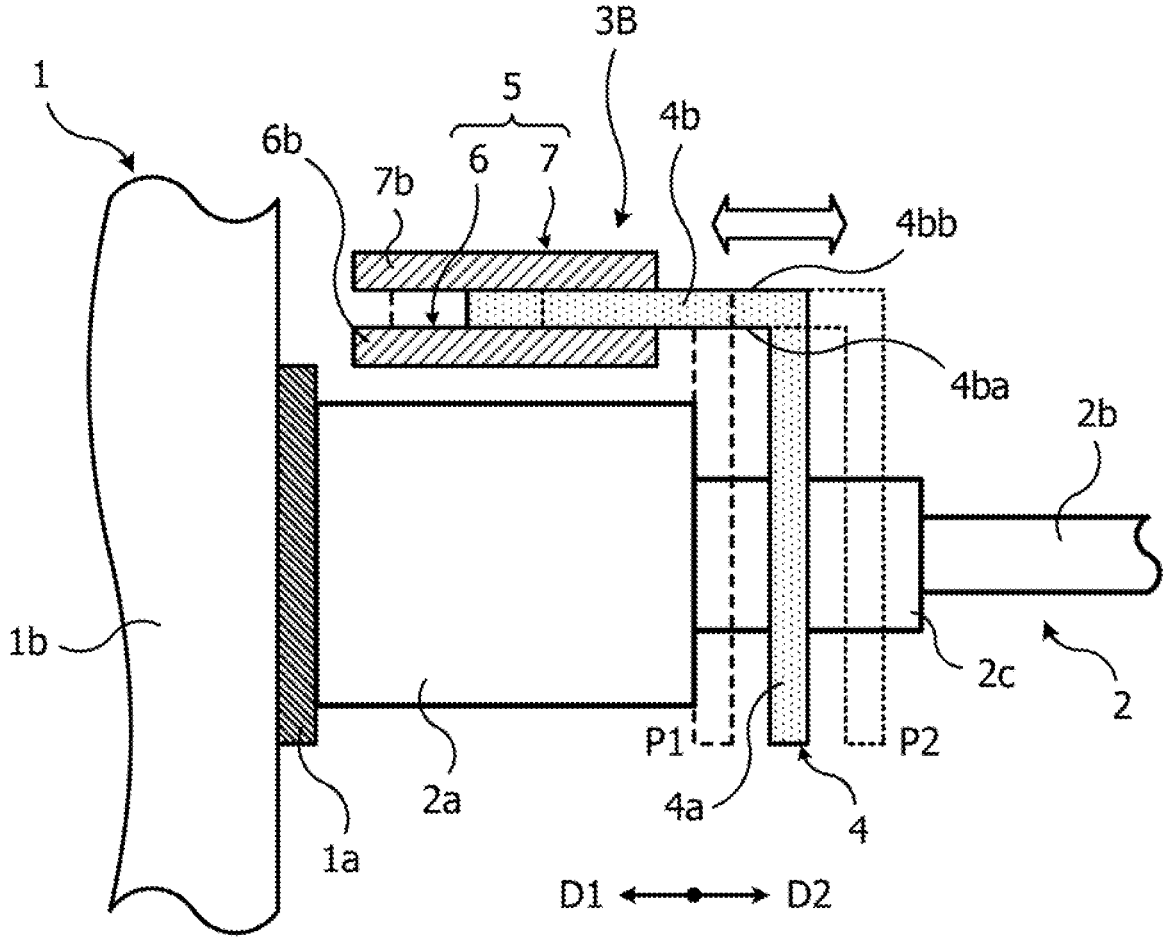
FIG. 3 is a diagram to describe a second exemplary cable fixture according to the first embodiment.

FIG. 3 is a diagram to describe a second exemplary cable fixture according to the first embodiment. FIG. 3 schematically illustrates a side view of a main portion of the exemplary cable fixture.

The electronic device 1 having the power cable 2 connected may be provided with a cable fixture 3B as illustrated in FIG. 3, for example. The cable fixture 3B illustrated in FIG. 3 includes the pressing member 4 having a plate portion 4*b* that is bent from an end of the plate portion 4*a* in the direction D1 and extending in the direction D1. The plate portion 4*a* faces the outlet 1*a* and the connector 2*a* plugged into the outlet 1*a*. Such a plate portion 4*b* extending in the direction D1 of the pressing member 4 is sandwiched between the plate portion 6*b* of the supporting tool 6 and the plate portion 7*b* of the supporting tool 7 of the supporting member 5 provided at a fixed position with respect to the outlet 1*a*. The plate portion 4*b* of the pressing member 4 is fixed at a predetermined position by being slid along the plate portion 6*b* of the supporting tool 6 or the plate portion 7*b* of the supporting tool 7 or along both of these plate portions in a state where the plate portion 4*b* is sandwiched between these plate portions.

In the cable fixture 3B, the plate portion 4*b* of the pressing member 4 is slid in the directions D1 and D2 along the plate portion 6*b* of the supporting tool 6 or the plate portion 7*b* of the supporting tool 7 or along both of the plate portions. Thus, the plate portion 4*a* of the pressing member 4 is displaced as indicated by a thick arrow in FIG. 3. Here, in FIG. 3, a state when the pressing member 4 (indicated by a solid line) at a certain position is slid in the direction D1 is indicated by a chain line P1, and a state when the pressing member 4 is slid in the direction D2 is indicated by a dotted line P2, respectively. For example, the plate portion 4*b* of the pressing member 4 is slid such that the plate portion 4*a* abuts on the connector 2*a* (the electric wire portion 2*b* or the stepped portion from the root covered portion 2*c* of the electric wire portion 2*b*) of the power cable 2. Then, the plate portion 4*b* is fixed at the abutment position (in the state indicated by the chain line P1) by the plate portion 6*b* of the supporting tool 6 and the plate portion 7*b* of the supporting tool 7 which sandwich the plate portion 4*b*.

In the cable fixture 3B, the plate portion 6*b* of the supporting tool 6 and the plate portion 7*b* of the supporting tool 7 in the supporting member 5 are provided at the fixed position with respect to the outlet 1*a* of the electronic device 1. The plate portion 4*b* of the pressing member 4 is slid along such a supporting member 5, and then fixed. Thus, the plate portion 4*a* of the pressing member 4 is fixed at the position where the plate portion 4*a* of the pressing member 4 abuts on the connector 2*a* of the power cable 2. The connector 2*a* is pressed in the direction D1 by the plate portion 4*a* of the pressing member 4 that is fixed by the abutment on the connector 2*a*, and the movement of the connector 2*a* in the direction D2 is restricted. Thus, the connector 2*a* is suppressed from coming off from the outlet 1*a*. As a result, the power failure caused by the connector 2*a* coming off from the outlet 1*a* is suppressed.

Similar to the above-described cable fixture 3A (FIGS. 1, 2A, and 2B), the cable fixture 3B (FIG. 3) has the mechanism in which the pressing member 4 is displaced and fixed by using the supporting tools 6 and 7. Therefore, even in a case where the size of the connector 2*a* to be plugged into the outlet 1*a* (size in each of the directions D1 and D2) is changed, the position of the pressing member 4 is adjusted in accordance with the size of the connector 2*a*, and it may be possible to suppress the connector 2*a* from coming off from the outlet 1*a*. With the cable fixture 3B also, the connector 2*a* of any size to be plugged into the outlet 1*a* is pressed to the outlet 1*a* side, and it may be possible to suppress the connector 2*a* from coming off from the outlet 1*a* and reduce the power failure caused by the coming-off of the connector 2*a*.

In the description of the first embodiment, the example in which the cable fixture 3A or the cable fixture 3B is applied to the connector 2*a* of the power cable 2 to be connected to the outlet 1*a* of the electronic device 1 is described. Besides, the cable fixture 3A and the cable fixture 3B are applicable not only to the connector 2*a* of the power cable 2 but also to connectors of various kinds of cables to be connected to outlets of various kinds of electronic devices.

Second Embodiment

For example, a description will be provided for connection between a power cable and an electronic device mounted on a rack and used in a data center or the like, and a cable fixture that suppresses coming-off of the power cable.

First, the description will be provided with reference to FIGS. 4 to 7 for exemplary connection between a power cable and an electronic device mounted on a rack, and an exemplary cable fixture (comparative example).

Figure 4:
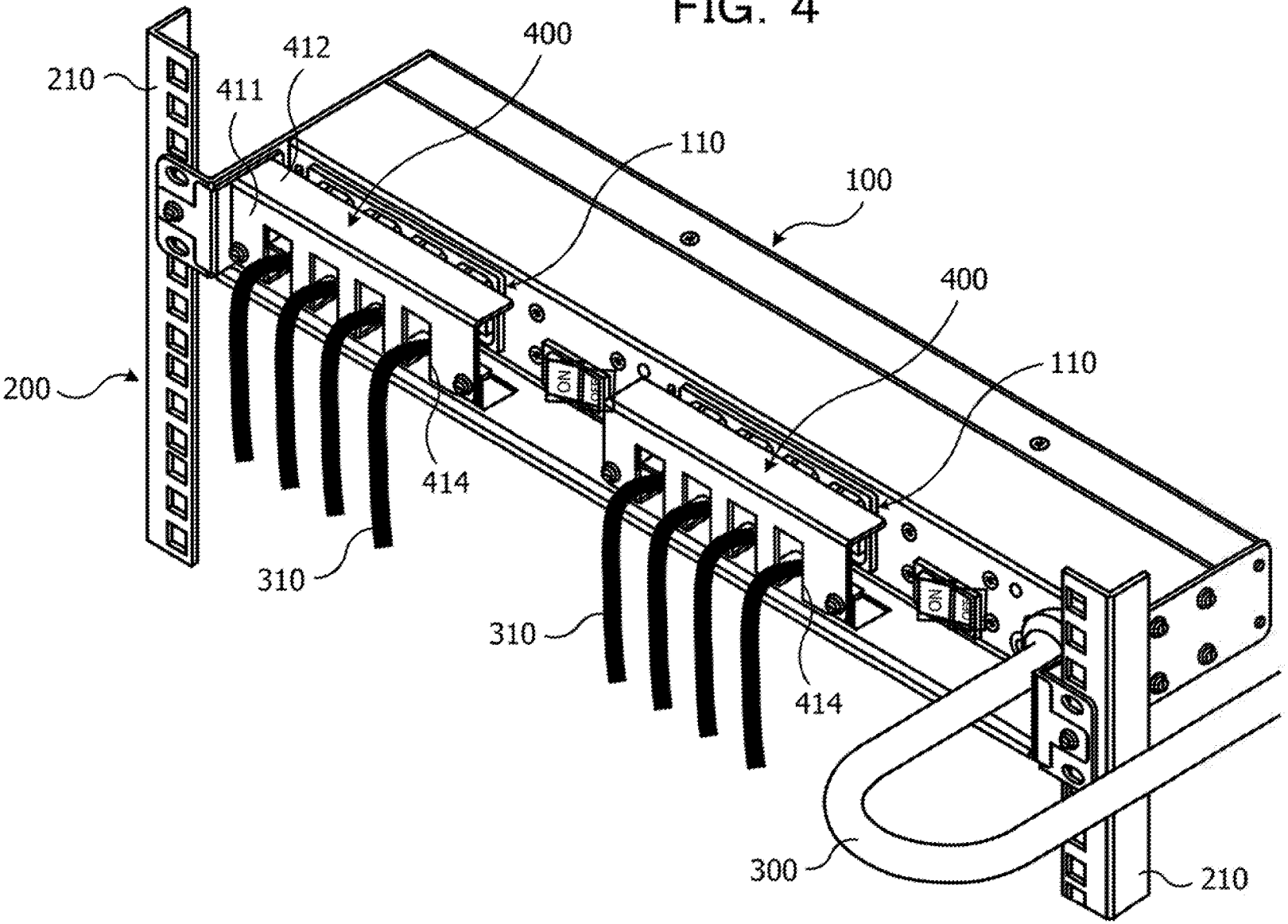
FIG. 4 is a view illustrating examples of: an electronic device mounted on a rack; a power cable connected to the electronic device; and a cable fixture.

FIG. 4 is a view illustrating respective examples of an electronic device mounted on the rack, power cables connected to the electronic device, and a cable fixture. FIG. 4 schematically illustrates a perspective view of a main portion including the respective examples of the electronic device, the power cables connected thereto, and the cable fixture.

Here, a power distribution unit (PDU) is exemplified as an example of the electronic device. For example, as illustrated in FIG. 4, a PDU 100 is fixed and mounted by screwing at a predetermined place of a frame 210 of a rack 200. The PDU 100 includes a main power cable 300 to supply power to this PDU 100. The PDU 100 includes a plurality of outlets. FIG. 4 illustrates, for example, the PDU 100 including two blocks 110 each including so-called quadruple outlets in which four outlets are provided in parallel (continuously arranged) (eight outlets in total). In the PDU 100 illustrated in FIG. 4, four power cables 310 are connected to one block 110 including the quadruple outlets (eight power cables in total in the two blocks 110).

Each power cable 310 has one end provided with a connector, and when the connector is plugged into each of the outlets of the PDU 100, the power cable is connected to the PDU 100. Each power cable 310 has the other end connected to another electronic device (not illustrated) mounted on the rack 200. The PDU 100 is supplied with power from the main power cable 300, and the power is distributed and supplied to another electronic device from the PDU 100 through each power cable 310. In the example of FIG. 4, a cable fixture 400 is provided in each block 110 including the quadruple outlets in order to suppress coming-off of each connector of each power cable 310 plugged into each outlet of the PDU 100.

Figure 5A:
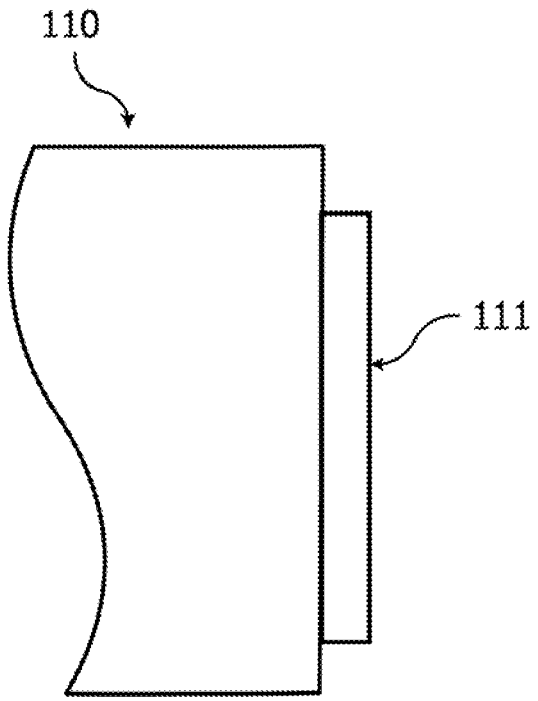
FIGS. 5A and 5B are diagrams illustrating an exemplary outlet.
Figure 5B:
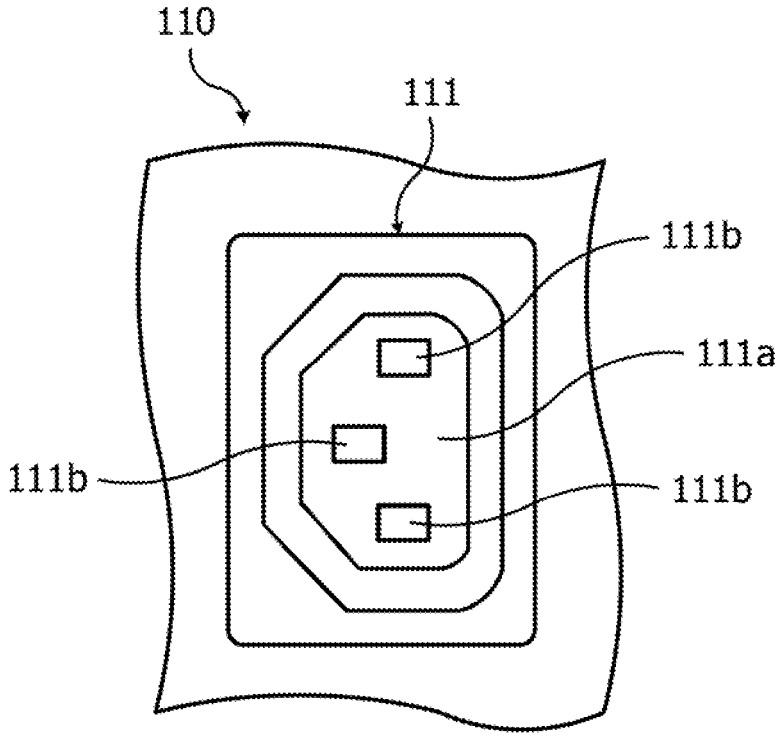
Figure 6A:
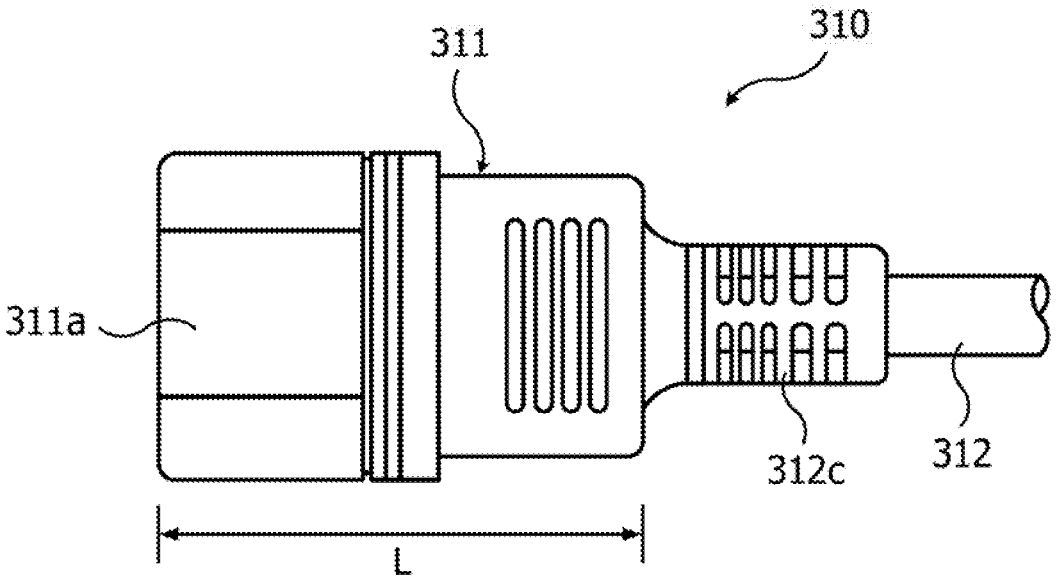
FIGS. 6A and 6B are diagrams illustrating an exemplary connector.
Figure 6B:
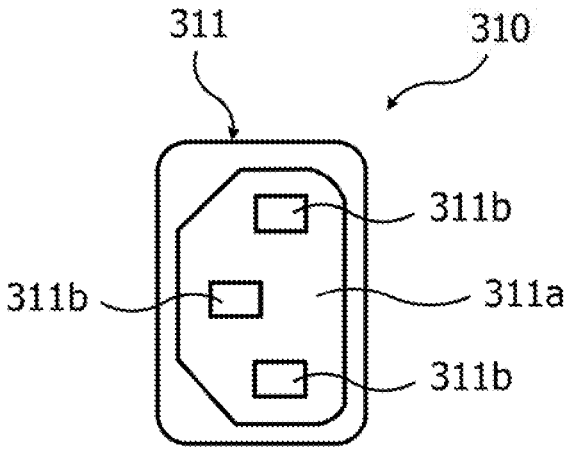

FIGS. 5A and 5B are diagrams illustrating an exemplary outlet. FIGS. 6A and 6B are diagrams illustrating an exemplary connector. FIG. 5A schematically illustrates a side view of a main portion of the exemplary outlet. FIG. 5B schematically illustrates a front view of the main portion of the exemplary outlet when viewed from a side where the connector is plugged. FIG. 6A schematically illustrates a side view of a main portion of the exemplary connector. FIG. 6B schematically illustrates a front view of the main portion of the exemplary connector when viewed from a side plugged into the outlet.

The PDU 100 includes, for example, an outlet 111 as illustrated in FIGS. 5A and 5B. As illustrated in FIG. 5B, the outlet 111 includes a recess 111*a* and three terminals 111*b* provided in the recess 111*a*. Four of such outlets 111 are provided in parallel in the block 110 of the PDU 100 as described above.

One end (root covered portion 312*c*) of an electric wire portion 312 of each power cable 310 is provided with a connector 311 as illustrated in FIGS. 6A and 6B, for example. As illustrated in FIGS. 6A and 6B, the connector 311 includes an inserting portion 311*a* to be plugged into the recess 111*a* of the outlet 111. As illustrated in FIG. 6B, the connector 311 has three terminals 311*b* provided inside the inserting portion 311*a*. The terminals 311*b* are connected to the three terminals 111*b* of the outlet 111, respectively. Such a connector 311 is plugged into each of the four outlets 111 provided in parallel in the block 110 of the PDU 100 as described above.

For example, the three terminals 111*b* on the outlet 111 side are male terminals, and the three terminals 311*b* on the connector 311 side are female terminals. The three terminals 111*b* on the outlet 111 side may be female terminals, and the three terminals 311*b* on the connector 311 side may be male terminals.

Figure 7A:
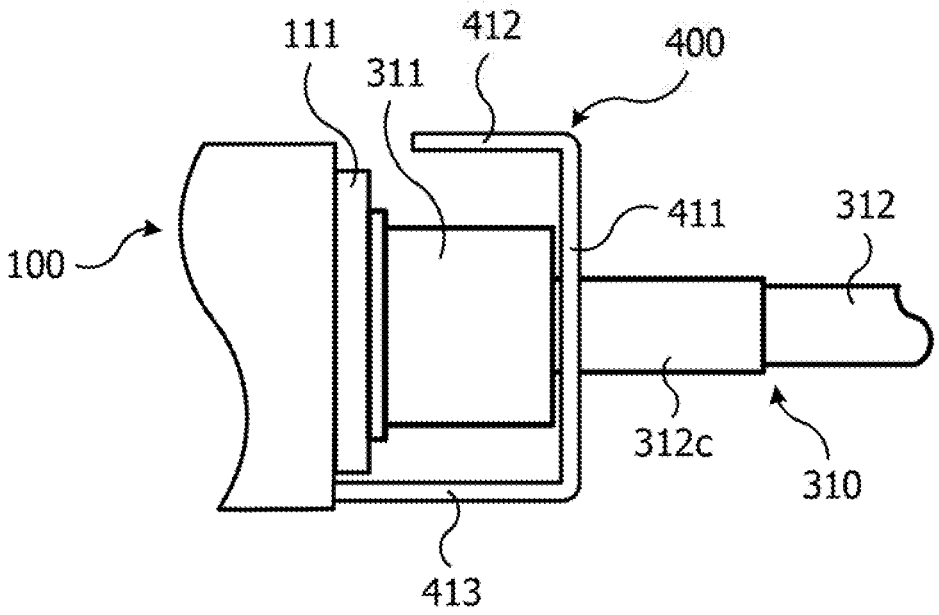
FIGS. 7A and 7B are diagrams illustrating an exemplary cable fixture.
Figure 7B:
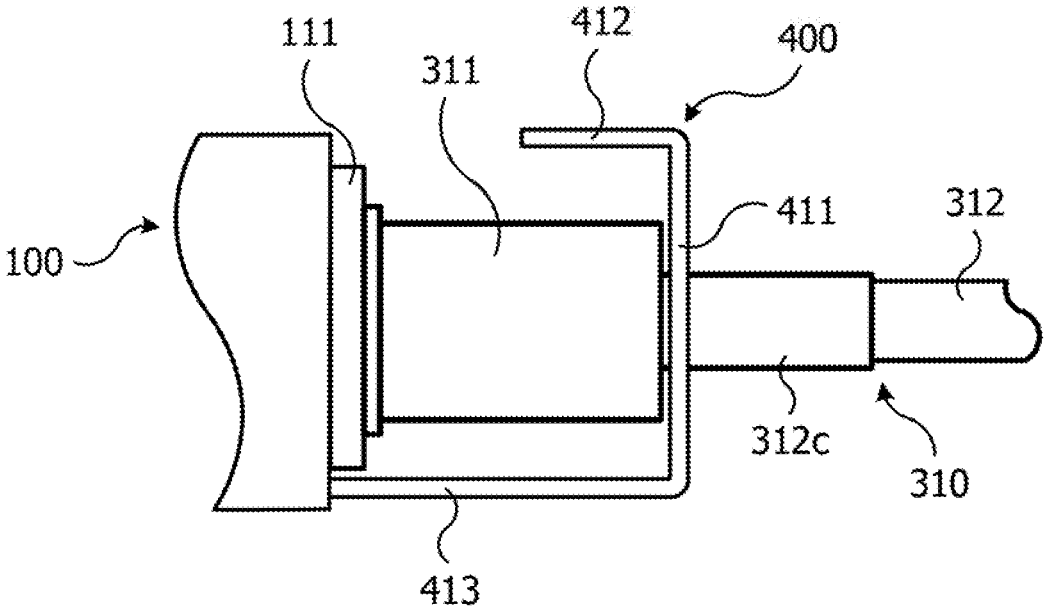

FIGS. 7A and 7B are diagrams illustrating an exemplary cable fixture. Each of FIGS. 7A and 7B schematically illustrates a side view of a main portion of the exemplary cable fixture.

As illustrated in FIG. 7A, the cable fixture 400 includes, for example: a plate portion 411 facing an outlet 111 of the PDU 100 and a connector 311 of the power cable 310 plugged into the outlet 111; and a plate portion 412 and a plate portion 413 which are bent toward the PDU 100 side from the plate portion 411. The cable fixture 400 is connected and fixed to the frame 210 of the rack 200 or the PDU 100 mounted thereon. The electric wire portion 312 of the power cable 310 is drawn out through an opening 414 (FIG. 4) provided on the plate portion 411 facing the outlet 111 and the connector 311. In the example of FIG. 7A, the plate portion 411 of the cable fixture 400 is positioned in a manner in which the plate portion 411 faces the connector 311 plugged into the outlet 111 (the electric wire portion 312 or a stepped portion from the root covered portion 312*c* of the electric wire portion 312). Thus, the connector 311 is suppressed from coming off from the outlet 111. As a result, power failure is suppressed in the electronic device that receives the power supply from the PDU 100 through each of the power cables 310.

In the cable fixture 400 as illustrated above in FIG. 7A, the position of the plate portion 411 is fixed with respect to the outlet 111. Therefore, in a case of using the power cable 310 including the connector 311 having a size that may be fitted between the outlet 111 and the plate portion 411 at the time of plugging the connector into the outlet 111, the cable fixture 400 may effectively suppress the connector 311 from coming off from the outlet 111. However, each of the power cables 310 connectable to the PDU 100 may include a connector 311 having a size having a varied value, such as a size L as illustrated above in FIG. 6A, for example.

Here, a case of using one cable fixture 400 as illustrated above in FIGS. 4 and 7A for each block 110 including the quadruple outlets as illustrated above in FIG. 4 will be discussed. In this case, it may be desired to use, for the quadruple outlets 111 of the one block 110, connectors 311 all having the same size. Additionally, each connector 311 may be desired to be fitted between each outlet 111 and each plate portion 411 at the time of plugging each connector 311 into each outlet 111. Therefore, a kind of the power cable 310 to be connected to the PDU 100 is limited to power cables that respectively include the connectors 311 all having the same size.

It may also be technically possible to provide a cable fixture 400 in accordance with a size of each connector 311 for each pair of an outlet 111 and a connector 311 to be plugged into the outlet 111. However, in this case, it may be desirable to separately prepare, for each connector 311 to be plugged into each outlet 111, a cable fixture 400 in accordance with a size of each connector 311 as illustrated in FIG. 7B, for example. Moreover, it may be desirable to perform installation work for the prepared cable fixture 400 for each connector 311 to be plugged into each outlet 111.

As another method, it is conceivable to provide a cable clamp in the vicinity of an outlet of a PDU such that a connector of a power cable currently plugged into an outlet is fixed by using this cable clamp. However, in such a method, it may be desirable to secure an installation area for the cable clamp in the vicinity of each of outlet, and it may be difficult to arrange a plurality of outlets in parallel at a narrow pitch. When the plurality of outlets is provided in parallel while securing the installation area for the cable clamp in the vicinity of each of the outlets, a pitch between the outlets is broadened. Therefore, the number of outlets that may be provided in the PDU may be reduced. For example, the number of electronic devices connected to the PDU and capable of supplying the power from the PDU may be reduced. Furthermore, in a case of upsizing the PDU in order to secure the number of outlets while securing the installation area for the cable clamp in the vicinity of each of outlets and broadening the pitch between the outlets, the number of electronic devices that may be mounted on a rack together with the PDU may be reduced.

Figure 8:
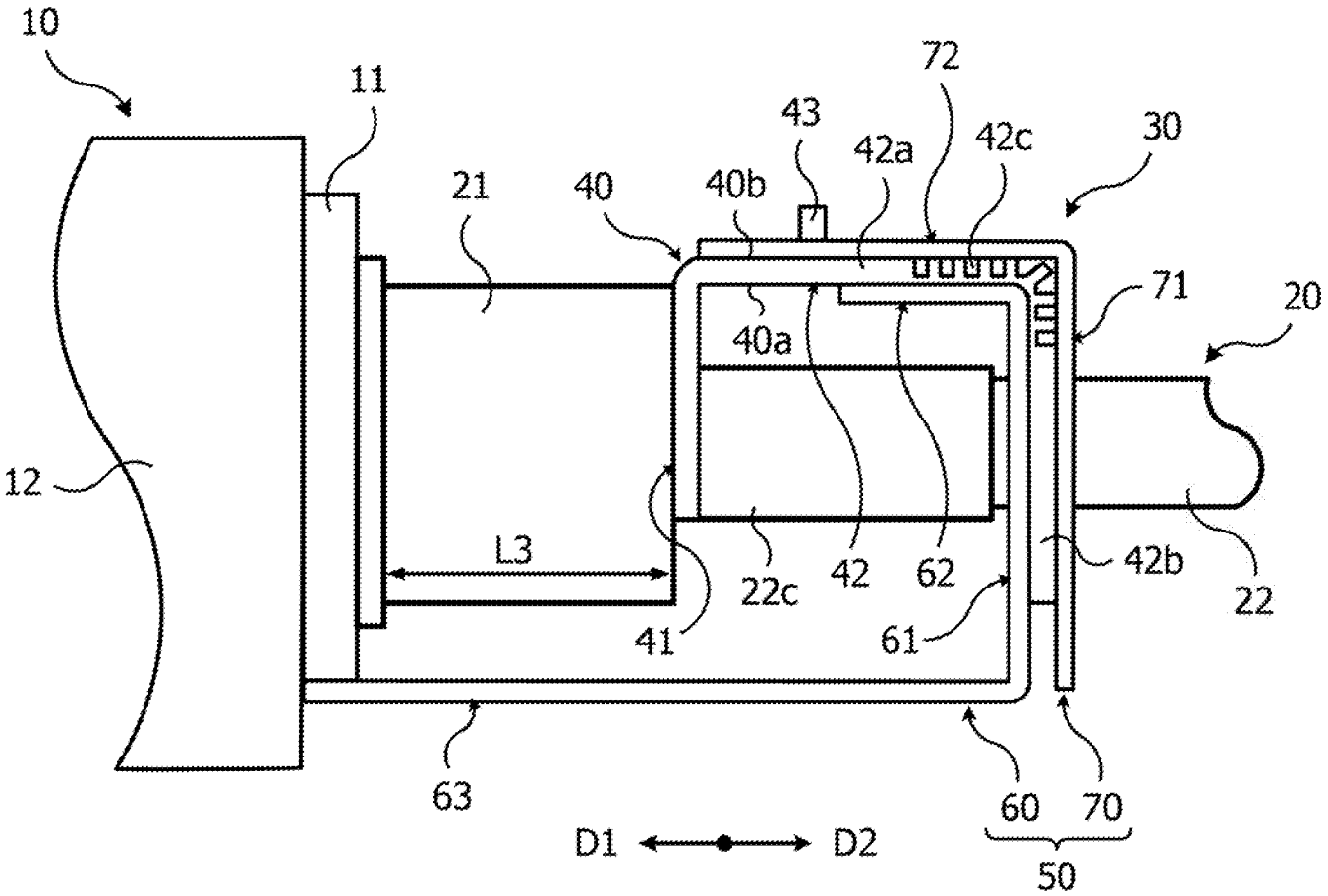
FIG. 8 is a diagram (part 1) to describe an exemplary cable fixture according to a second embodiment.
Figure 9:
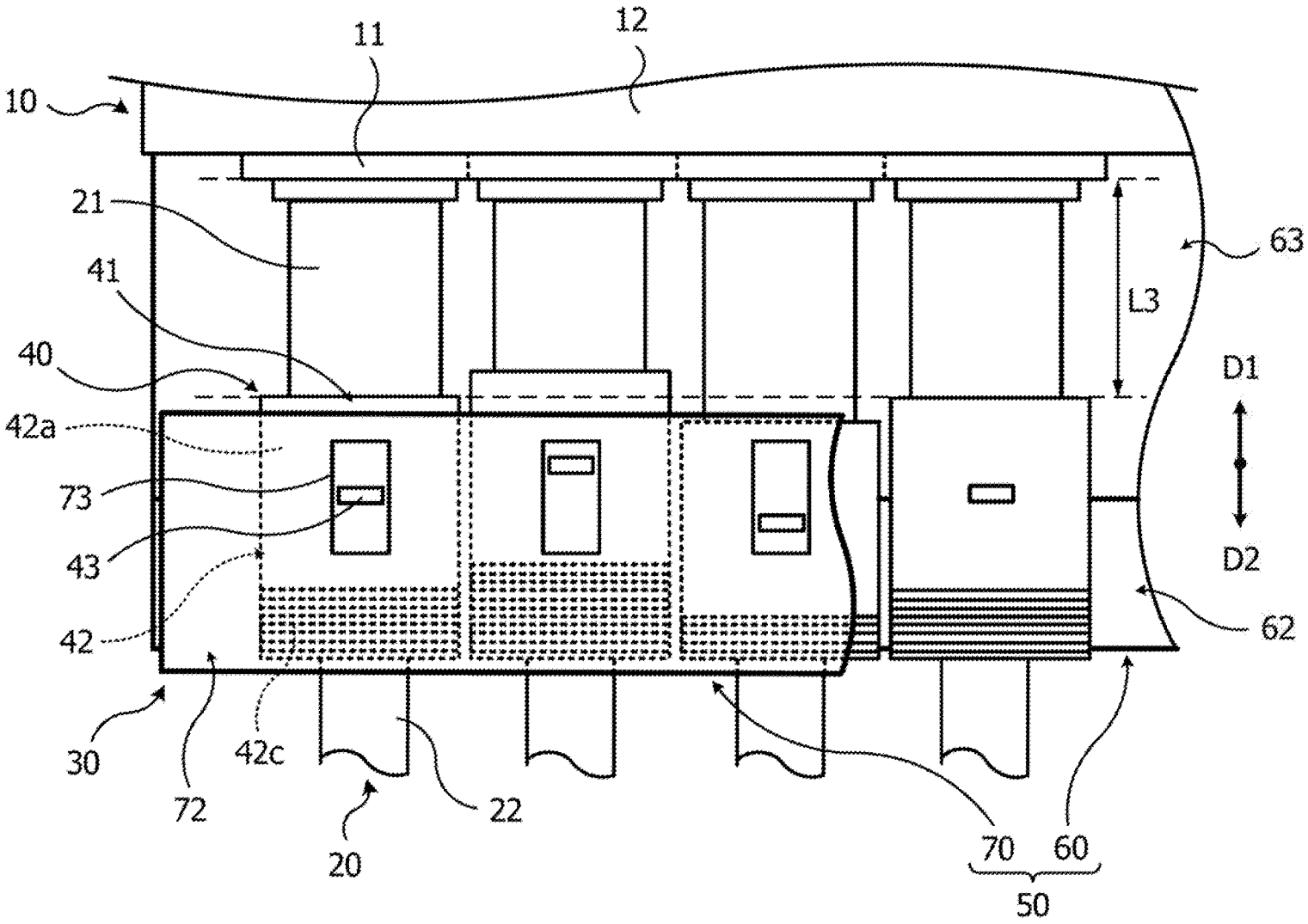
FIG. 9 is a diagram (part 2) to describe the exemplary cable fixture according to the second embodiment.
Figure 10:
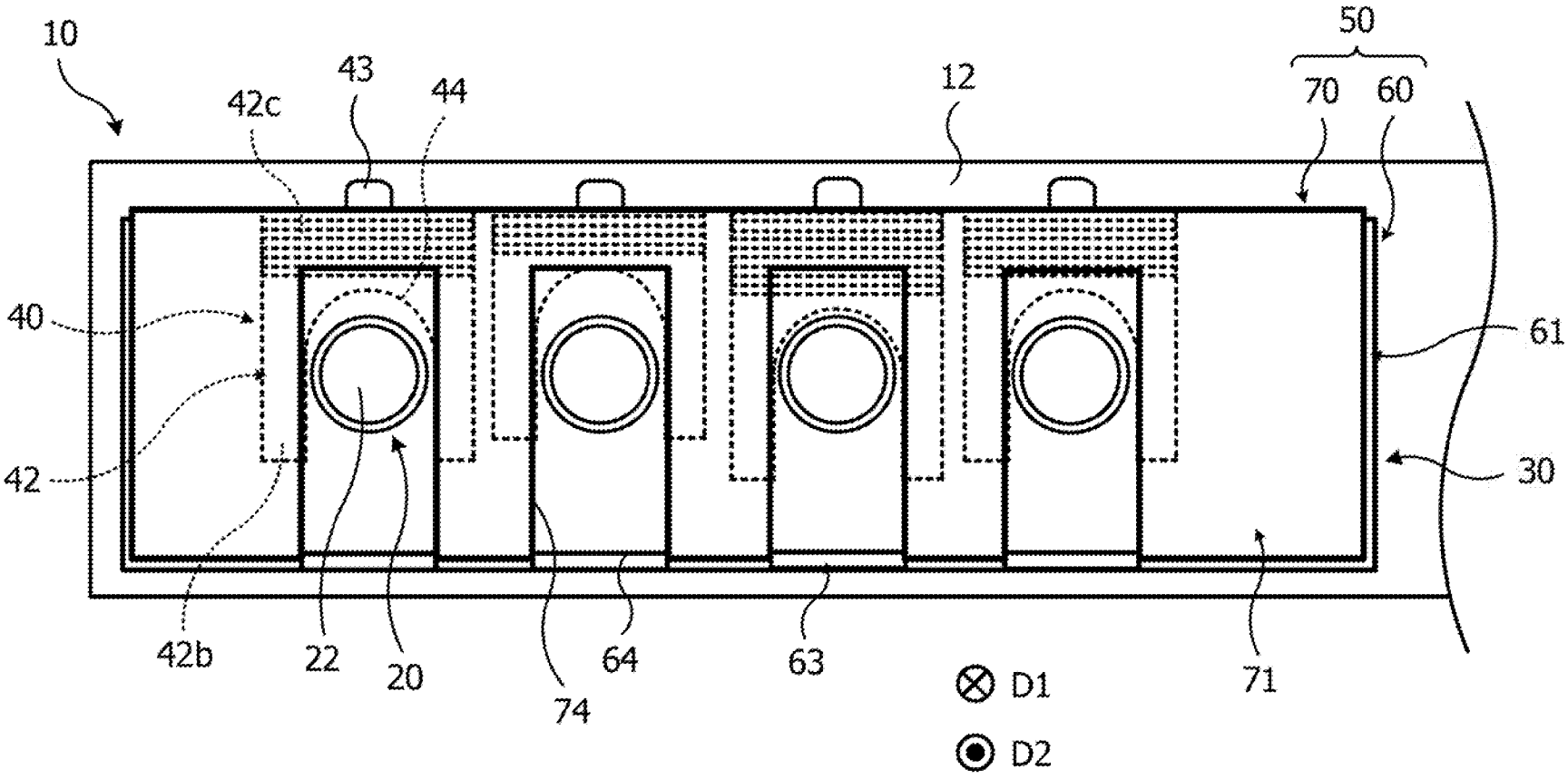
FIG. 10 is a diagram (part 3) to describe the exemplary cable fixture according to the second embodiment.

Considering the above points, a configuration as illustrated in FIGS. 8 to 10 is employed as a cable fixture in the second embodiment.

FIGS. 8 to 10 are diagrams to describe an exemplary cable fixture according to the second embodiment. FIG. 8 schematically illustrates a side view of a main portion of the exemplary cable fixture. FIG. 9 schematically illustrates a top view of the main portion of the exemplary cable fixture. FIG. 10 schematically illustrates a front view of the main portion of the exemplary cable fixture.

As illustrated in FIGS. 8 to 10, a power cable 20 to supply power to another electronic device is connected to a PDU 10 (electronic device). The PDU 10 includes outlets 11 provided in a main body 12 of the PDU 10. Here, for example, the PDU 10 includes quadruple outlets 11 (FIGS. 9 and 10). A power cable 20 is connected to each of the outlets 11. For each of the outlets 11 in the PDU 10, an outlet having a configuration as exemplified above in FIGS. 5A and 5B may be employed.

Each power cable 20 includes an electric wire portion 22 having one end (root covered portion 22*c*) provided with a connector 21. For a connector 21 of each power cable 20, a connector having a configuration as exemplified above in FIGS. 6A and 6B may be employed. Each power cable 20 is connected to the PDU 10 by plugging its connector 21 into an outlet 11 in a direction D1 approaching the outlet 11. The power cable 20 is detached from the PDU 10 by pulling out the connector 21 currently plugged into the outlet 11 from the outlet 11 in a direction D2 away from the outlet 11.

A cable fixture 30 as illustrated in FIGS. 8 to 10 is provided in the PDU 10 to which the power cables 20 are connected. The cable fixture 30 includes pressers 40 (pressing members) and a dummy support 50 (supporting member) that supports the pressers 40.

One presser 40 is provided for every pair including: an outlet of the four outlets 11 of the PDU 10; and a connector of the connectors 21 of the four power cables 20 plugged into the four outlets (FIGS. 9 and 10). Each presser 40 includes: a plate portion 41 (examples of a first plate portion and a seventh plate portion) facing an outlet 11 and a connector 21 plugged into the outlet 11; and a plate portion 42 bent from the plate portion 41 (examples of a second plate portion and an eighth plate portion). Each plate portion 42 includes: a region 42*a* bent from the plate portion 41 and extending in the direction D2; and a region 42*b* further bent from an end in the direction D2 of the region 42*a* and facing the outlet 11 and the connector 21. A resin material is used for the presser 40. The presser 40 includes, on a surface of a predetermined area of the plate portion 42, a plurality of cutout portions 42*c* (recesses) extending in a direction orthogonal to a direction in which the plate portion 42 is bent (bent direction). A knob 43 protruding at a predetermined height is provided on the plate portion 42 of the presser 40. The plate portion 41 and the plate portion 42 of the presser 40 include an opening 44 (FIG. 10) through which the electric wire portion 22 leading to the connector 21 is made to pass.

The dummy support 50 includes a fixing metal fitting 60 (supporting tool) and a presser metal fitting 70 (supporting tool) which sandwich a plate portion 42 of each presser 40 from both sides of the plate portion 42. One fixing metal fitting 60 and one presser metal fitting 70 are provided per a plurality of pressers 40. The plate portions 42 of the plurality of pressers 40 are sandwiched between a pair including the fixing metal fitting 60 and the presser metal fitting 70 (FIGS. 9 and 10). The pressers 40 are supported by the dummy support 50 that sandwiches the plate portions 42 of the pressers 40 with the fixing metal fitting 60 and the presser metal fitting 70.

The fixing metal fitting 60 includes: a plate portion 62 (an example of a third plate portion) facing surfaces 40*a* of the plate portions 42 of the pressers 40; a plate portion 61 (an example of a fourth plate portion) bent at an end in the direction D2 of the plate portion 62 and facing the outlets 11 and the connectors 21; and a plate portion 63 bent at a lower end of the plate portion 61 and extending in the direction D1. The plate portion 62 and the plate portion 61 of the fixing metal fitting 60 include openings 64 (FIG. 10) through which the electric wire portions 22 leading to the connectors 21 are made pass, respectively. For the fixing metal fitting 60, a metal material is used, for example. The fixing metal fitting 60 is fixed to the rack on which the PDU 10 is mounted, or to the PDU 10.

The presser metal fitting 70 includes: a plate portion 72 (an example of a fifth plate portion) facing other surfaces 40*b* (opposite surfaces of the surfaces 40*a*) of the plate portions 42 of the pressers 40; and a plate portion 71 (an example of a sixth plate portion) bent at an end in the direction D2 of the plate portion 72 and facing the outlets 11 and the connectors 21 (also facing the plate portion 61 of the fixing metal fitting 60). The plate portion 72 of the presser metal fitting 70 includes openings 73 (FIG. 9) at positions corresponding to the knobs 43 provided on the respective plate portions 42 of the pressers 40. Each of the openings 73 has an opening size that allows displacement of a knob 43 in the directions D1 and D2. Each knob 43 has a height so as to protrude from a surface of the plate portion 72 through each opening 73, for example. The plate portion 71 of the presser metal fitting 70 includes openings 74 (FIG. 10) through which the electric wire portions 22 leading to the connectors 21 are made to pass, respectively. A metal material is used for the presser metal fitting 70. The presser metal fitting 70 is fixed to the fixing metal fitting 60 by the screwing.

The plate portions 42 of the pressers 40 are sandwiched between the plate portion 62 of the fixing metal fitting 60 and the plate portion 72 of the presser metal fitting 70. Since the presser metal fitting 70 is fixed to the fixing metal fitting 60 by the screwing, the plate portions 42 of the pressers 40 are sandwiched and fixed between the plate portion 72 and the plate portion 62. Before the presser metal fitting 70 is fixed to the fixing metal fitting 60 by the screwing, a plate portion 42 of each presser 40 is slidable in the directions D1 and D2 (facing direction between a plate portion 41 of each presser 40 and a connector 21) along the plate portion 62 of the fixing metal fitting 60 or along the plate portion 62 of the fixing metal fitting 60 and the plate portion 72 of the presser metal fitting 70 which are fixed by the screwing. A plate portion 41 of each presser 40 abuts on each connector 21 plugged into a corresponding outlet 11 (an electric wire portion 22 or a stepped portion from a root covered portion 22*c* of the electric wire portion 22). In the state where the plate portion 41 of each presser 40 abuts on each connector 21, the presser metal fitting 70 is fixed to the fixing metal fitting 60 by the screwing. Thus, the plate portions 42 sandwiched between these fittings are fixed, and the positions of the respective presser 40 are fixed.

For example, each presser 40 is fixed by sliding its plate portion 42 in accordance with a size L3 of a connector 21 to be plugged into an outlet 11, and adjusting a plate portion 41 to a position where the plate portion 41 abuts on the connector 21. Here, as illustrated in FIG. 9, the description is provided for the example in which the power cable 20 including the connector 21 having the size L3 indicated by a chain line, a power cable 20 including a connector 21 having a size larger than the size L3, and a power cable 20 including a connector 21 having a size smaller than the size L3 are connected to the respective outlets 11. The cable fixture 30 is adaptable to fix the connectors 21 of any size by adjusting the respective pressers 40 (FIGS. 9 and 10).

The cable fixture 30 will be further described.

First, a presser 40 of the cable fixture 30 will be described.

Figure 11A:
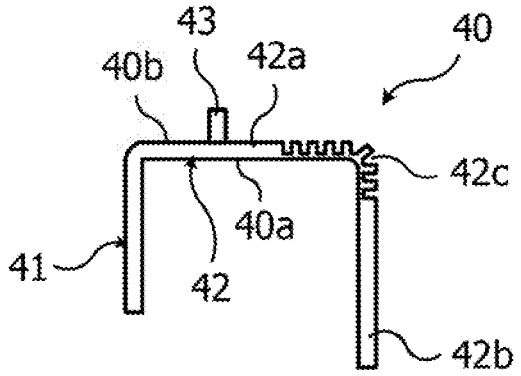
FIGS. 11A, 11B, and 11C are diagrams (part 1) to describe an exemplary presser of the cable fixture according to the second embodiment.
Figure 11B:
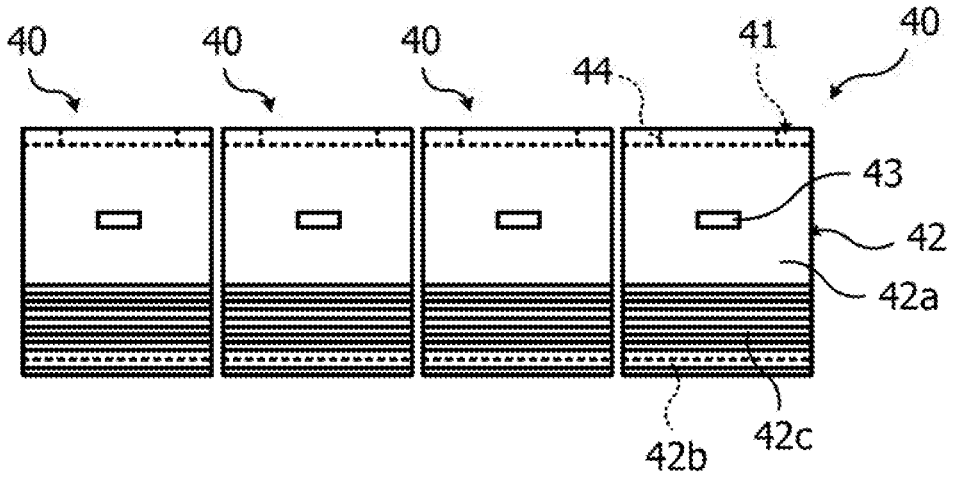
Figure 11C:
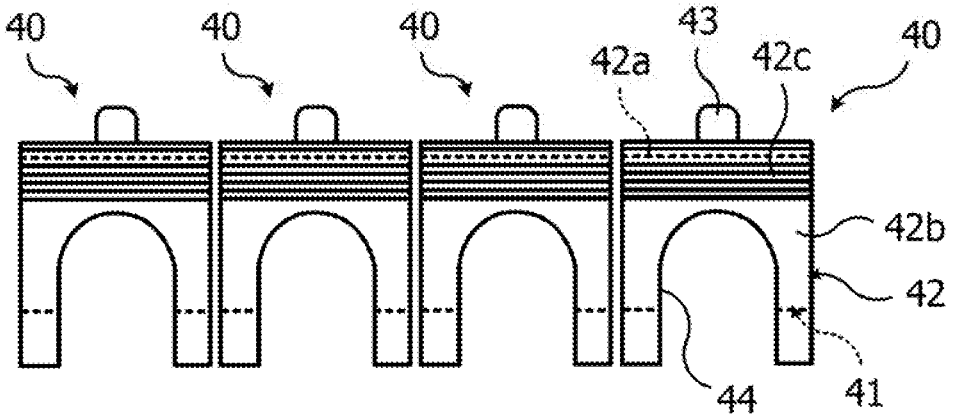
Figure 12A:
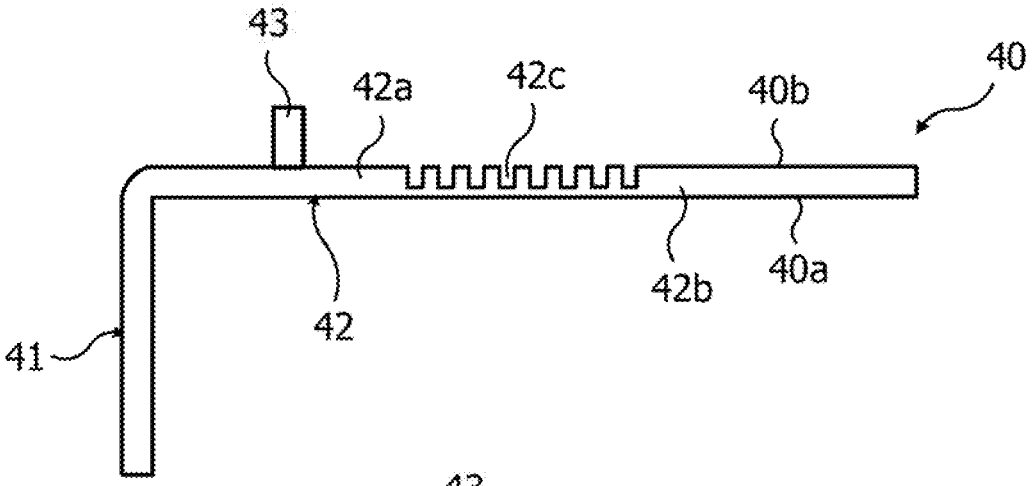
FIGS. 12A, 12B, and 12C are diagrams (part 2) to describe the exemplary presser of the cable fixture according to the second embodiment.
Figure 12B:
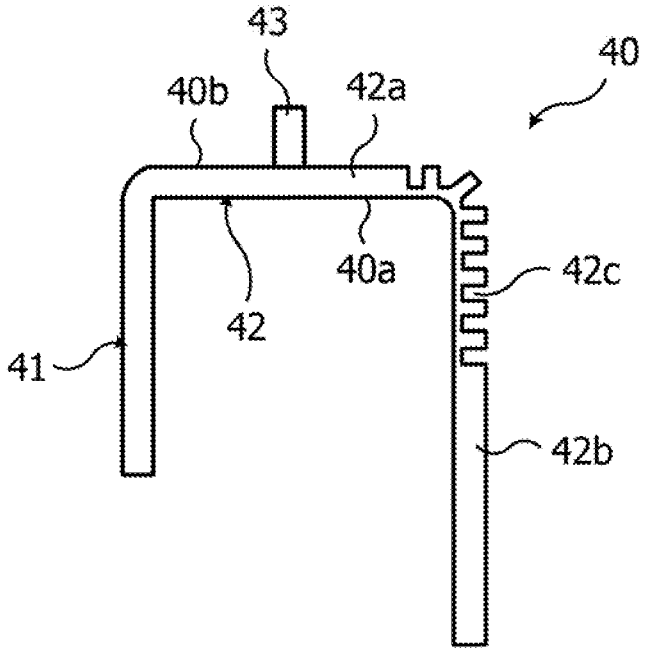
Figure 12C:
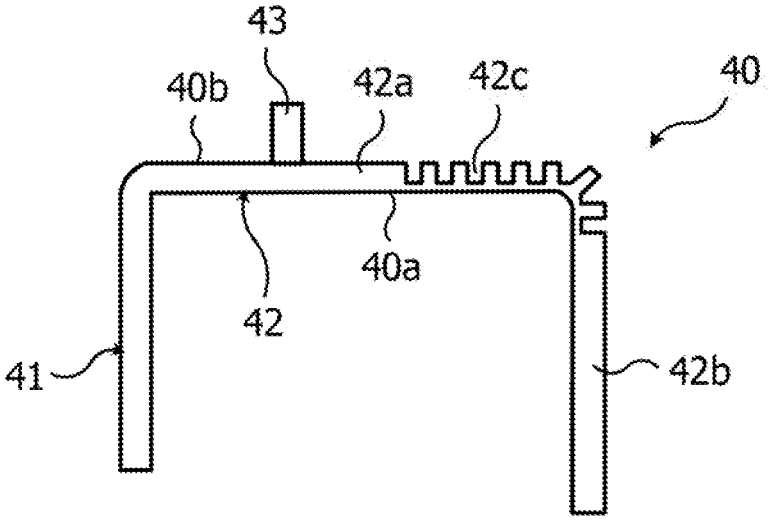

FIGS. 11A, 11B, 11C, 12A, 12B, and 12C are diagrams to describe an exemplary presser of the cable fixture according to the second embodiment. FIG. 11A schematically illustrates a side view of the exemplary presser, FIG. 11B schematically illustrates a top view of the exemplary presser, and FIG. 11C schematically illustrates a front view of the exemplary presser. FIG. 12A schematically illustrates a side view of the exemplary presser before being bent, and each of FIGS. 12B and 12C schematically illustrates a side view of the exemplary presser that is bent.

Each presser 40 of the cable fixture 30 is formed by using a resin material having predetermined rigidity in a cured state. As illustrated in FIGS. 11A to 11C, the presser 40 includes a plate portion 41 and a plate portion 42 bent from the plate portion 41. Each plate portion 41 faces: an outlet 11 of the above-described PDU 10; and a connector 21 of an above-described power cable 20 plugged into the outlet 11. The plate portion 41 and the plate portion 42 include an opening 44 (FIG. 11C) through which an electric wire portion 22 leading to the connector 21 is made to pass. The plate portion 42 includes: a region 42*a* bent from the plate portion 41; and a region 42*b* further bent from the region 42*a*. The plate portion 42 includes a plurality of cutout portions 42*c* extending in a direction orthogonal to the bent direction. The plate portion 42 is bent along a place of any cutout portion 42*c* among the plurality of cutout portions 42*c*, and one side of a bent portion becomes the region 42*a*, and the other side of the bent portion becomes the region 42*b*. A knob 43 is provided on (the region 42*a*) of the plate portion 42. The knob 43 is used to adjust a place to bend the plate portion 42 along a cutout portion 42*c*.

Before the plate portion 42 is bent along a cutout portion 42*c*, the presser 40 is made into an L-shape in the side view as illustrated in FIG. 12A, for example. The L-shape includes the plate portion 41 and the plate portion 42 bent from the plate portion 41. When the plate portion 42 is bent along the cutout portion 42*c* at a predetermined place, the plate portion 42 is made into, for example, a U-shape (or a horseshoe shape) in the side view as illustrated in FIG. 12B or 12C. The U-shape includes: the plate portion 41; and the region 42*a* and the region 42*b* of the plate portion 42. A distance to the plate portion 41 from the bent place of the plate portion 42, for example, a length of the region 42*a* is adjusted by adjusting the place to bend the plate portion 42 along the cutout portion 42*c*. For example, when the plate portion 42 is bent at a place of a cutout portion 42*c* relatively close to the plate portion 41 from the state as illustrated in FIG. 12A, the presser 40 having a relatively short distance from the bent place to the plate portion 41 (the length of the region 42*a*) is obtained as illustrated in FIG. 12B. When the plate portion 42 is bent at a place of a cutout portion 42*c* relatively far from the plate portion 41 from the state as illustrated in FIG. 12A, the presser 40 having a relatively long distance from the bent place to the plate portion 41 (the length of the region 42*a*) is obtained as illustrated in FIG. 12C. Since a bent place of each plate portion 42 is adjustable, a plate portion 41 of each presser 40 may be able to abut on a connector 21 of any size.

Next, the fixing metal fitting 60 of the cable fixture 30 will be described.

Figure 13A:
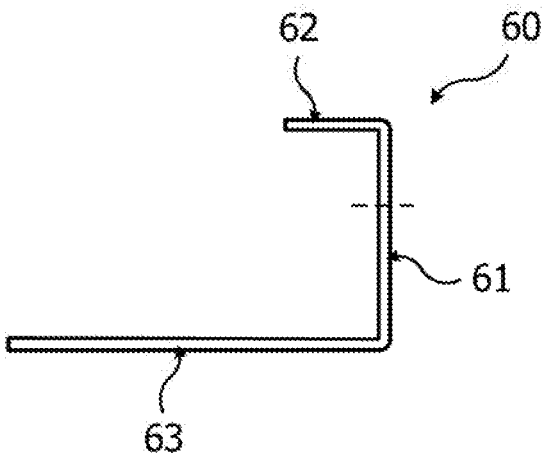
FIGS. 13A, 13B, and 13C are diagrams to describe an exemplary fixing metal fitting of the cable fixture according to the second embodiment.
Figure 13B:
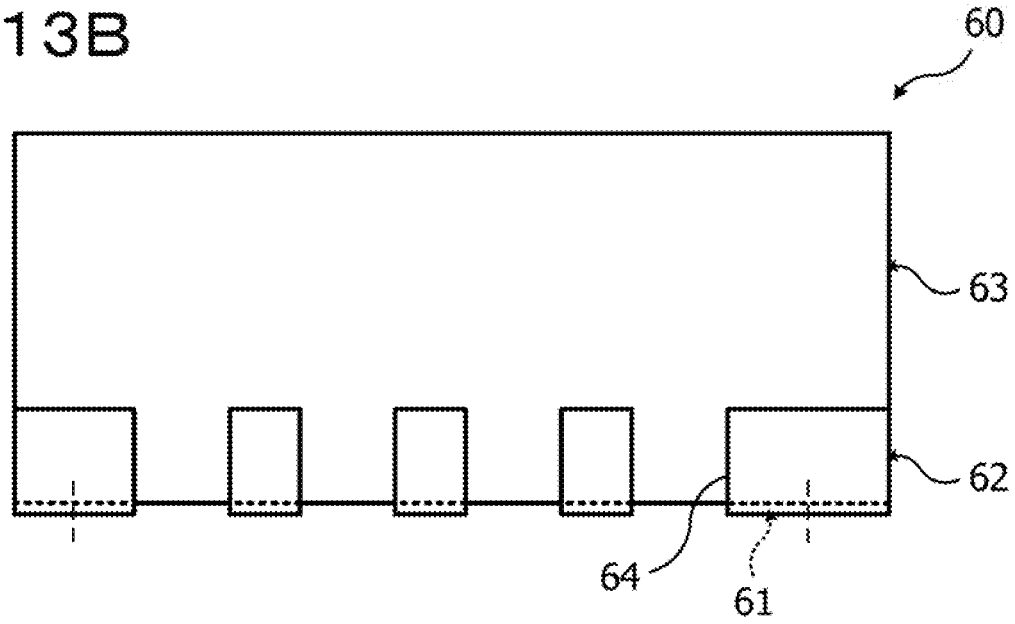
Figure 13C:
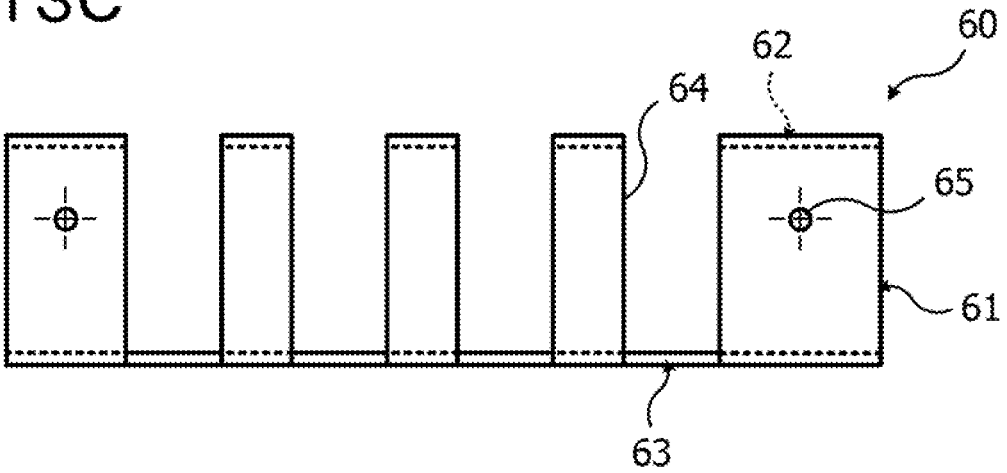

FIGS. 13A, 13B, and 13C are diagrams to describe an exemplary fixing metal fitting of the cable fixture according to the second embodiment. FIG. 13A schematically illustrates a side view of the exemplary fixing metal fitting, FIG. 13B schematically illustrates a top view of the exemplary fixing metal fitting, and FIG. 13C schematically illustrates a front view of the exemplary fixing metal fitting.

The fixing metal fitting 60 of the cable fixture 30 is formed by using a metal material having predetermined rigidity. As illustrated in FIGS. 13A to 13C, the fixing metal fitting 60 includes a plate portion 62, a plate portion 61 bent from the plate portion 62, and a plate portion 63 further bent from the plate portion 61. The plate portion 62 faces the surfaces 40*a* of the plate portions 42 of the above-described pressers 40, and the plate portion 61 faces the outlets 11 of the above-described PDU 10 and the connectors 21 of the above-described power cables 20 plugged into the outlets 11. The plate portion 62 and the plate portion 61 include four openings 64 (four openings corresponding to the quadruple outlets 11 in this example: FIGS. 13B and 13C) through which the electric wire portions 22 leading to the connectors 21 are made to pass, respectively. The plate portion 61 includes two screw holes 65 (two screw holes in this example: FIG. 13C) in order to fix the presser metal fitting 70 to the fixing metal fitting 60 by screwing. In FIGS. 13A and 13B, only positions where the screw holes 65 are provided are illustrated by chain lines.

Next, the presser metal fitting 70 of the cable fixture 30 will be described.

Figure 14A:
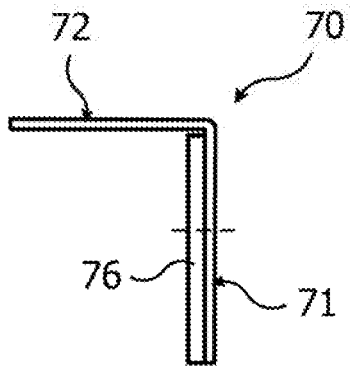
FIGS. 14A, 14B, and 14C are diagrams to describe an exemplary presser metal fitting of the cable fixture according to the second embodiment.
Figure 14B:
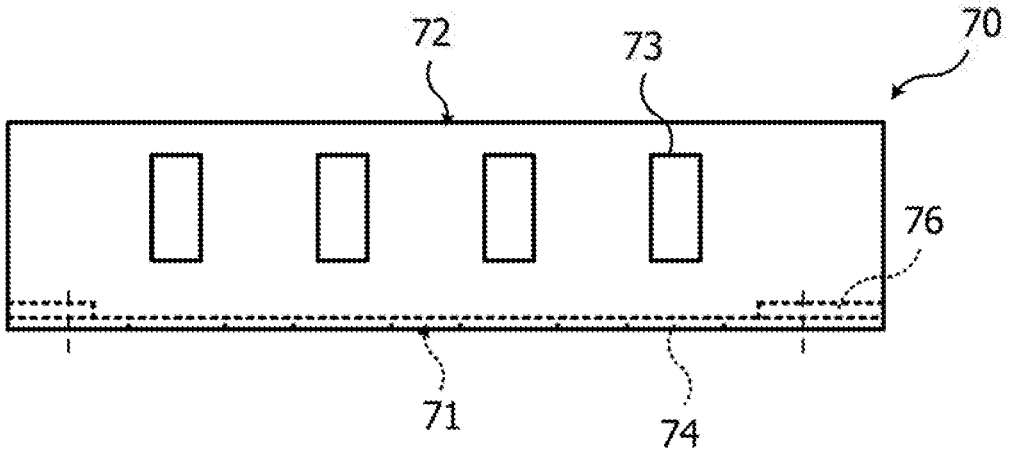
Figure 14C:
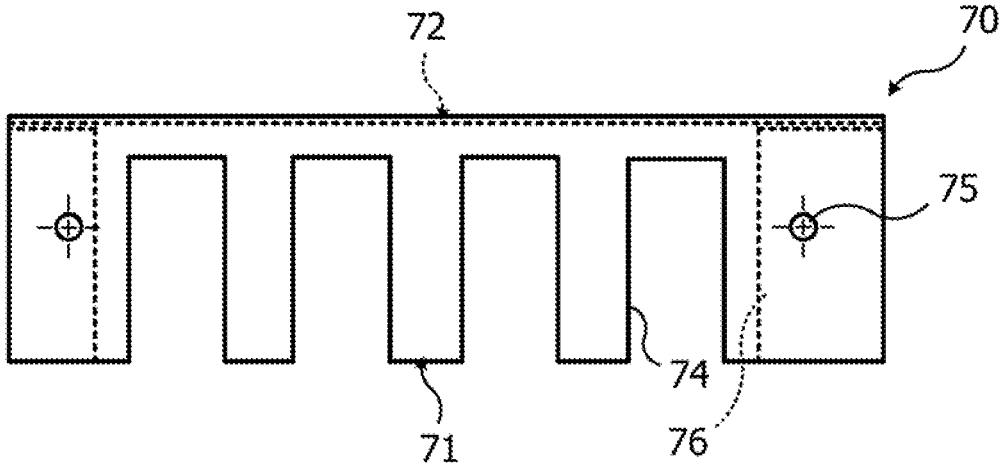

FIGS. 14A, 14B, and 14C are diagrams to describe an exemplary presser metal fitting of the cable fixture according to the second embodiment. FIG. 14A schematically illustrates a side view of the exemplary presser metal fitting, FIG. 14B schematically illustrates a top view of the exemplary presser metal fitting, and FIG. 14C schematically illustrates a front view of the exemplary presser metal fitting.

The presser metal fitting 70 of the cable fixture 30 is formed by using a metal material having predetermined rigidity. As illustrated in FIGS. 14A to 14C, the presser metal fitting 70 includes a plate portion 72, and a plate portion 71 bent from the plate portion 72. The plate portion 72 faces the surfaces 40*b* of the plate portions 42 of the above-described pressers 40, and the plate portion 71 faces the outlets 11 of the above-described PDU 10 and the connectors 21 of the above-described power cables 20 respectively plugged into the outlets 11. The plate portion 72 includes openings 73 (four openings corresponding to the quadruple outlets 11 in this example: FIG. 14B) at positions corresponding to the knobs 43 respectively provided on the plate portions 42 of the pressers 40. The plate portion 71 includes four openings 74 (four openings corresponding to the quadruple outlets 11 in this example: FIG. 14C) through which the electric wire portions 22 leading to the connectors 21 are made to pass, respectively. The plate portion 71 includes screw holes 75 (two screw holes in this example: FIG. 14C) in order to fix the presser metal fitting 70 to the fixing metal fitting 60 at the positions corresponding to the screw holes 65 of the fixing metal fitting 60. In FIGS. 14A and 14B, only the positions where the screw holes 75 are provided are illustrated by chain lines. The plate portion 71 may further include a spacer 76 having a thickness equivalent to a thickness of each of the pressers 40 sandwiched between the fixing metal fitting 60 and the presser metal fitting 70.

In the cable fixture 30 having the configuration as illustrated above in FIGS. 8 to 14C, the pressers 40 are provided on the fixing metal fitting 60 provided at the fixed position, and the presser metal fitting 70 is fixed to the fixing metal fitting 60 by the screwing while sandwiching the pressers 40. In each presser 40, a bent position of a plate portion 42 (place of a cutout portion 42*c*) is adjusted in accordance with a size of each connector 21 plugged into an outlet 11. Thus, a plate portion 41 of the presser 40 is made to abut on the connector 21. The adjustment of the bent position of the plate portion 42 and the abutment of the plate portion 41 on the connector 21 are performed in accordance with a size of each connector 21 plugged into each outlet 11 of the PDU 10. In the cable fixture 30, even when the connectors 21 respectively plugged into the outlets 11 of the PDU 10 have different sizes, each connector 21 may be pressed to each outlet 11 side by a plate portion 41 of a corresponding presser 40 that abuts on the connector 21. According to the cable fixture 30, a connector 21 of any size to be plugged into an outlet 11 may be pressed to an outlet 11 side, and the connector 21 may be suppressed from coming off from the outlet 11.

Next, a method of fixing a power cable 20 connected to a PDU 10 by using the above-described cable fixture 30 will be described with reference to FIGS. 15A to 21C.

FIGS. 15A to 21C are diagrams to describe a fixing method using the cable fixture according to the second embodiment.

Figure 15A:
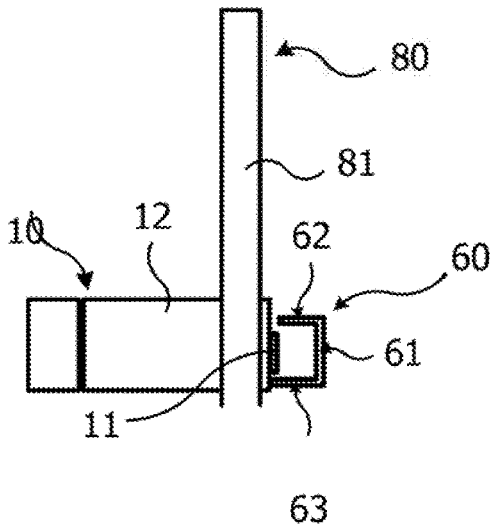
FIGS. 15A, 15B, and 15C are diagrams (part 1) to describe a fixing method using the cable fixture according to the second embodiment.
Figure 15B:
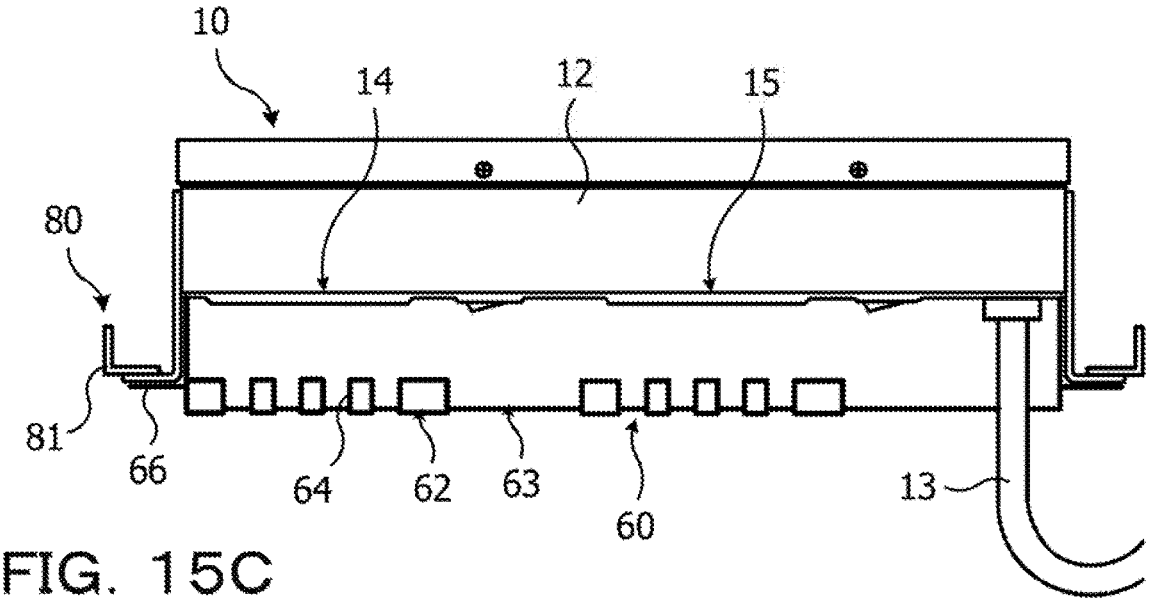
Figure 15C:
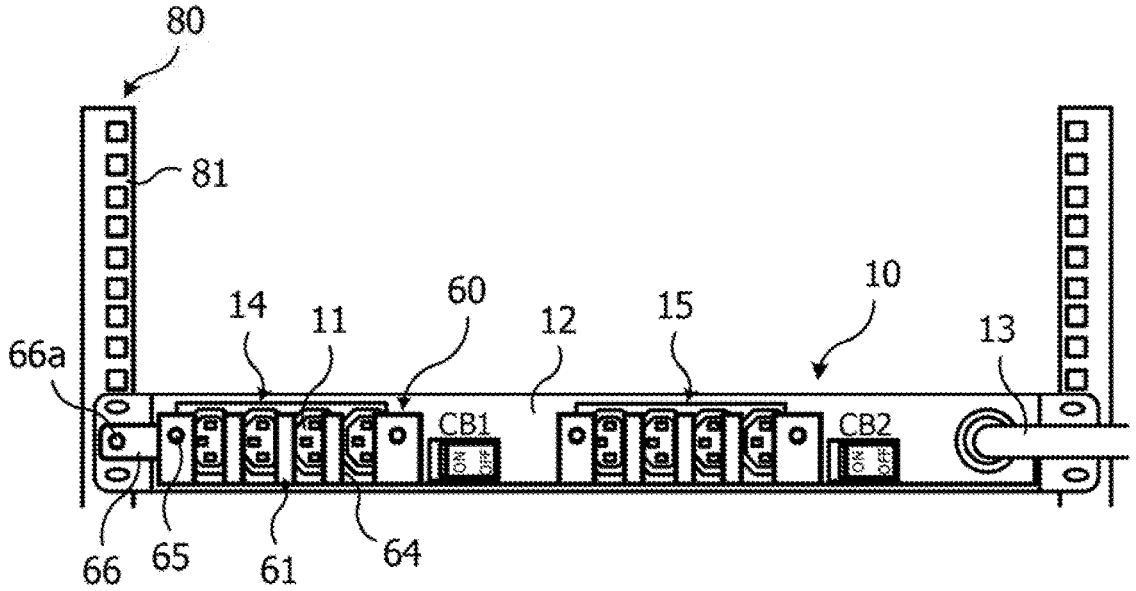
Figure 16A:
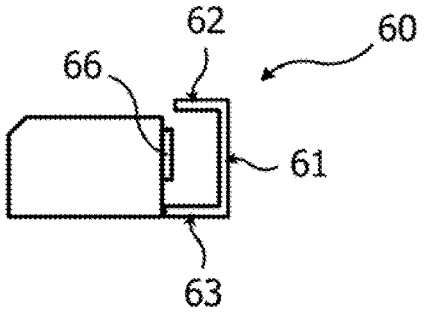
FIGS. 16A, 16B, and 16C are diagrams (part 2) to describe the fixing method using the cable fixture according to the second embodiment.
Figure 16B:
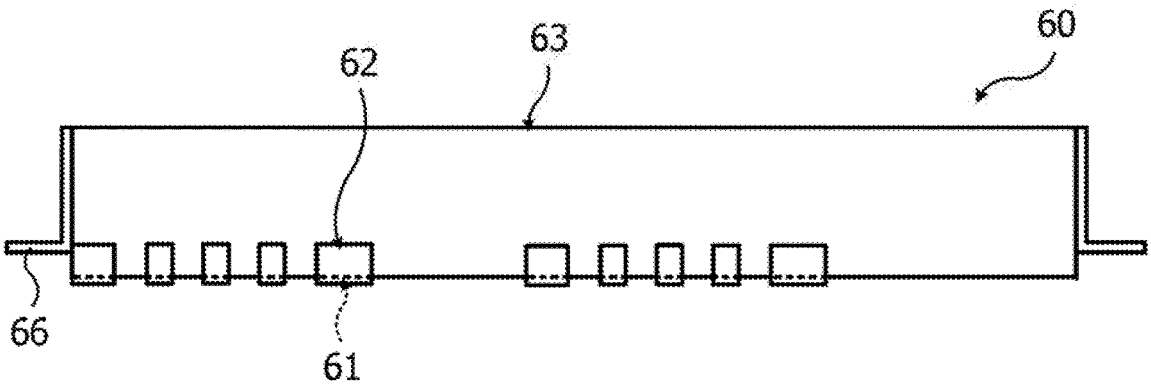
Figure 16C:
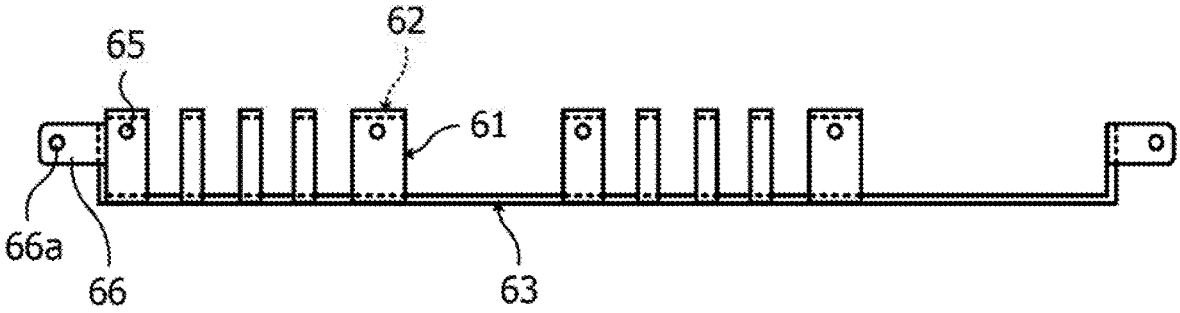

FIGS. 15A, 15B, 15C are diagrams illustrating an exemplary PDU including the fixing metal fitting. FIG. 15A is a side view, FIG. 15B is a top view, and FIG. 15C is a front view. FIGS. 16A, 16B, and 16C are diagrams illustrating an exemplary fixing metal fitting provided in the PDU. FIG. 16A is a side view, FIG. 16B is a top view, and FIG. 15C is a front view.

For example, as illustrated in FIGS. 15A to 15C, the PDU 10 including a main power cable 13 leading to the main body 12 is attached and mounted on a frame 81 of the rack 80 by the screwing. Here, for example, the PDU 10 including two of the quadruple outlets (blocks 14 and 15) is illustrated. In each of the blocks, four outlets 11 are provided in parallel. For example, a 19-inch rack is used as the rack 80, and the PDU 10 having a height of 1 U (44.45 mm) that is a unit standard height is mounted on the rack 80.

For example, the fixing metal fitting 60 is attached to the frame 81 of the rack 80 on which the PDU 10 is mounted. For the fixing metal fitting 60, a fixing metal fitting having the configuration as described above in FIGS. 13A to 13C is used for each of the blocks 14 and 15 of the outlets 11 of the PDU 10 as illustrated in FIGS. 16A to 16C. The fixing metal fitting 60 illustrated in FIGS. 16A to 16C includes, in a manner corresponding to each of the blocks 14 and 15: the plate portion 62; the plate portion 61 bent from the plate portion 62; the plate portion 63 further bent from the plate portion 61; and the openings 64 through which the power cables 20 are made to pass respectively; and the screw holes 65 to fix the presser metal fitting 70. The fixing metal fitting 60 is fixed together with the PDU 10 to the frame 81 of the rack 80 by screwing at a projecting portion 66 projecting laterally and including a screw hole 66*a*.

The fixing metal fitting 60 as illustrated in FIGS. 16A to 16C is prepared, and the prepared fixing metal fitting 60 is fixed together with the PDU 10 to the frame 81 of the rack 80. Thus, the state as illustrated in FIGS. 15A to 15C is obtained.

Besides, the fixing metal fitting 60 may be preliminarily integrated with the PDU 10 as a part of the PDU 10. A state similar to the state illustrated in FIGS. 15A to 15C may also be obtained by mounting, on the rack 80, the PDU 10 thus preliminarily integrated with the fixing metal fitting 60.

Figure 17A:
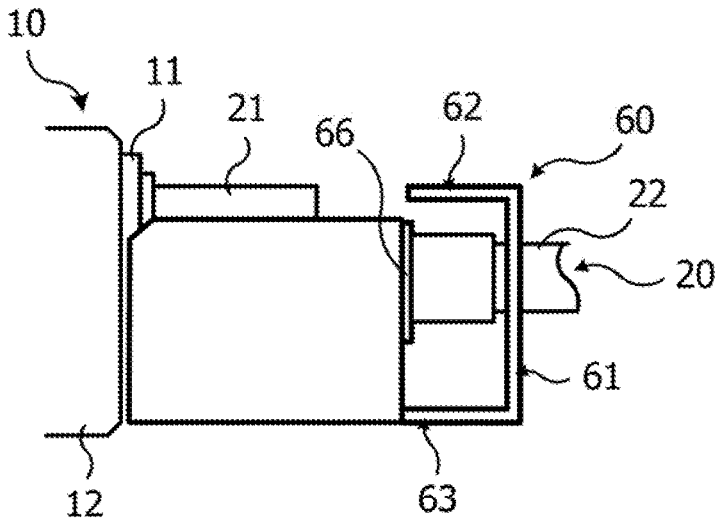
FIGS. 17A, 17B, and 17C are diagrams (part 3) to describe the fixing method using the cable fixture according to the second embodiment.
Figure 17B:
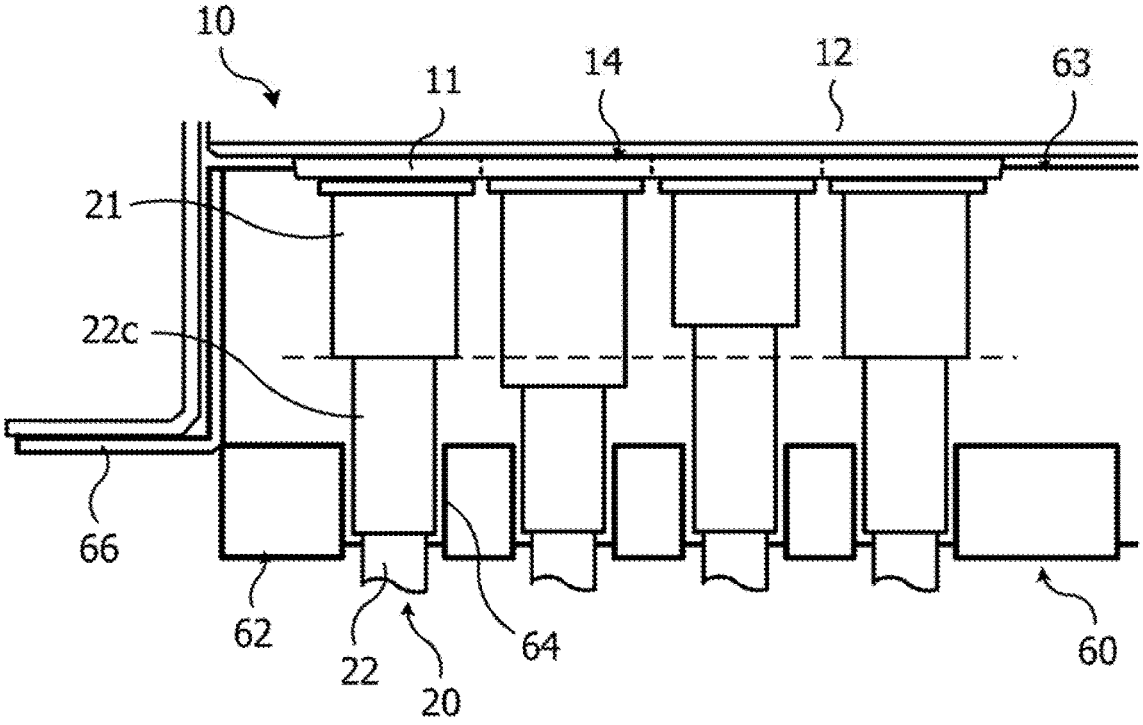
Figure 17C:
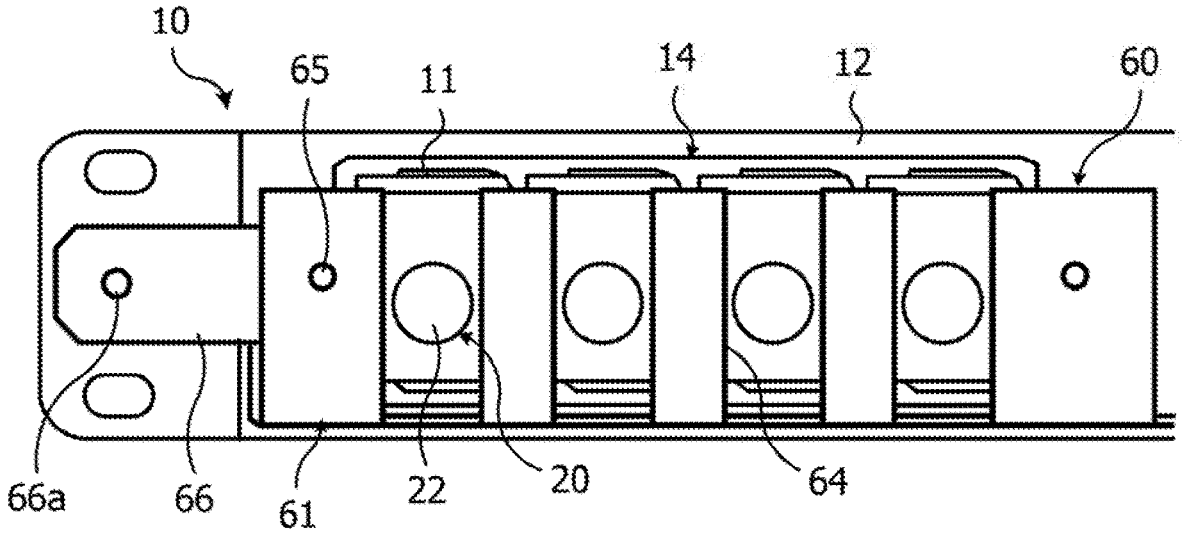

FIGS. 17A, 17B, and 17C are diagrams illustrating an exemplary state where power cables are connected to a PDU. FIG. 17A is a side view, FIG. 17B is a top view, and FIG. 17C is a front view.

FIGS. 17A to 17C focus on the block 14 among the above-described two blocks 14 and 15 of the PDU 10. In FIGS. 17A to 17C, illustration of the frame 81 of the rack 80 is omitted.

As illustrated in FIGS. 17A to 17C, connectors 21 of respective power cables 20 are plugged into respective outlets 11 of the PDU 10 provided with the fixing metal fitting 60. Here, for example, a state where power cables 20 having connectors 21 of different sizes are connected to some of the outlets 11 of the PDU 10 is illustrated. For example, as indicated by a chain line of FIG. 17B in this example, the power cables 20 including the connectors 21 having the same size are connected to outlets 11 positioned at both ends among the four outlets 11 of the block 14. Among remaining two outlets in the block 14, a power cable 20 including a connector 21 having a size larger than the sizes of other power cables 20 is connected to one of remaining two outlets 11, and a power cable 20 including a connector 21 having a size smaller than the sizes of other power cables 20 is connected to the other one of the remaining two outlets 11.

An electric wire portion 22 of each power cable 20 including a connector 21 to be plugged into each outlet 11 passes through an opening 64 provided in the fixing metal fitting 60 and drawn out.

Figure 18A:
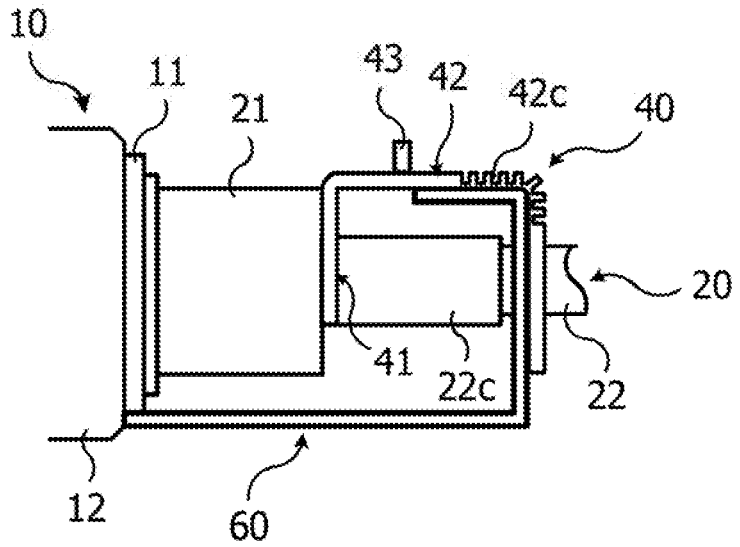
FIGS. 18A, 18B, and 18C are diagrams (part 4) to describe the fixing method using the cable fixture according to the second embodiment.
Figure 18B:
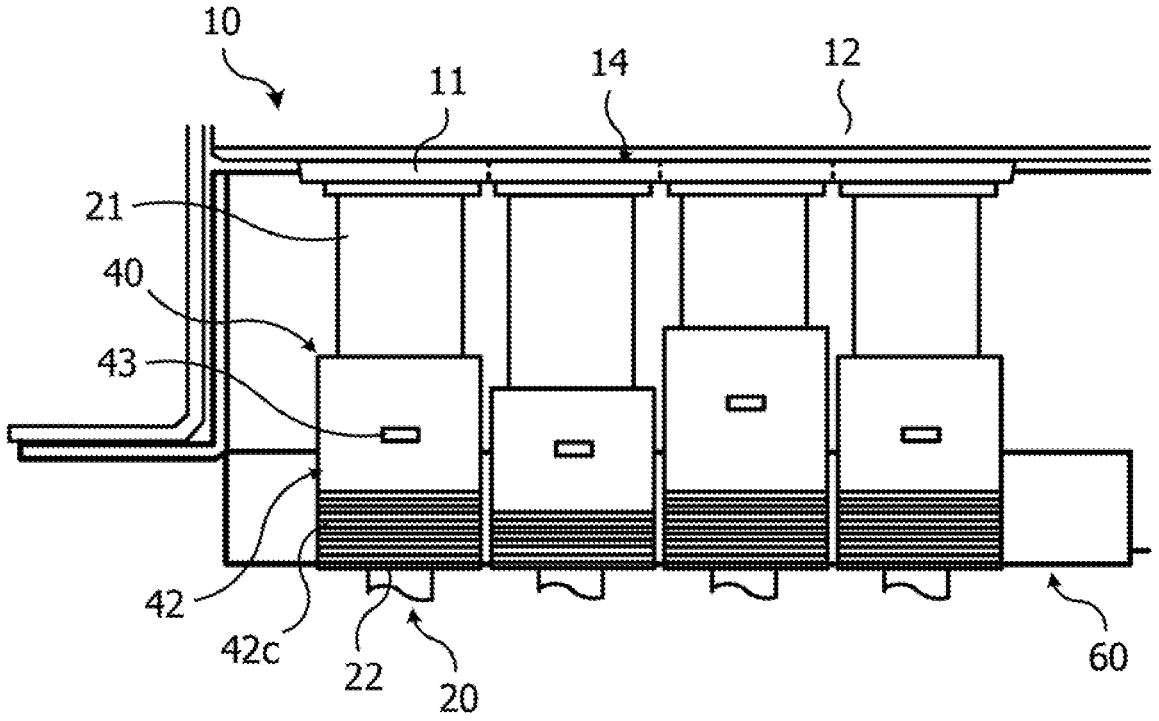
Figure 18C:
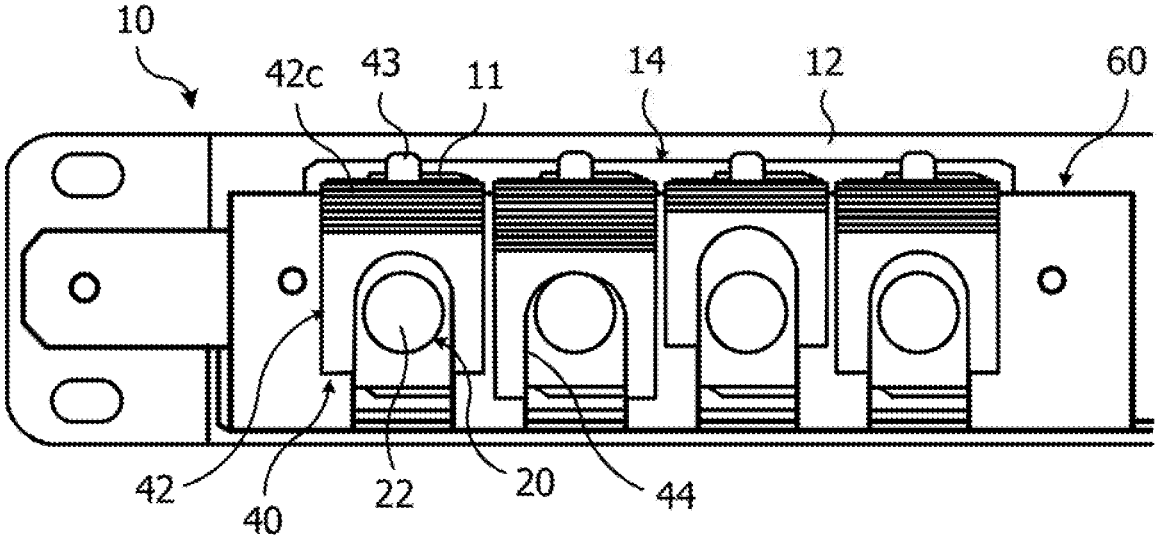

FIGS. 18A, 18B, and 18C are diagrams illustrating an exemplary state where a presser is provided. FIG. 18A is a side view, FIG. 18B is a top view, and FIG. 18C is a front view.

FIGS. 18A to 18C focus on the block 14 among the above-described two blocks 14 and 15 of the PDU 10. In FIGS. 18A to 18C, illustration of the frame 81 of the rack 80 is omitted, and illustration of a side plate (FIG. 17A) of the fixing metal fitting 60 is omitted in FIG. 18A.

The fixing metal fitting 60 is provided and the connectors 21 of the power cables 20 are plugged into the outlets 11 respectively in the PDU 10. The pressers 40 are provided on the fixing metal fitting 60 in a manner corresponding to the respective connectors 21 as illustrated in FIGS. 18A to 18C. For each presser 40, a presser having the configuration as described above in FIGS. 11A to 11C and FIGS. 12A to 12C is used. Each presser 40 includes: the plate portion 41; the plate portion 42 bent from the plate portion 41; the cutout portion 42*c* and the knob 43 provided in the plate portion 42; and the opening 44 through which the corresponding power cable 20 is made to pass.

In each presser 40 on the fixing metal fitting 60, a bent position of the plate portion 42 (a place of a cutout portion 42*c*) is adjusted in accordance with a size of a connector 21 plugged into an outlet 11. Thus, the plate portion 41 is made to abut on the connector 21 (a stepped portion from a root covered portion 22*c* of the electric wire portion 22). The adjustment of the bent position of each plate portion 42 is performed by using each knob 43, for example. The electric wire portion 22 of each power cable 20 including a connector 21 plugged into an outlet 11 is made to pass through an opening 44 provided in each presser 40.

An exemplary method of making (a plate portion 41) of each presser 40 abut on a connector 21 will be described in detail later (FIGS. 20A to 21C and the like).

Figure 19A:
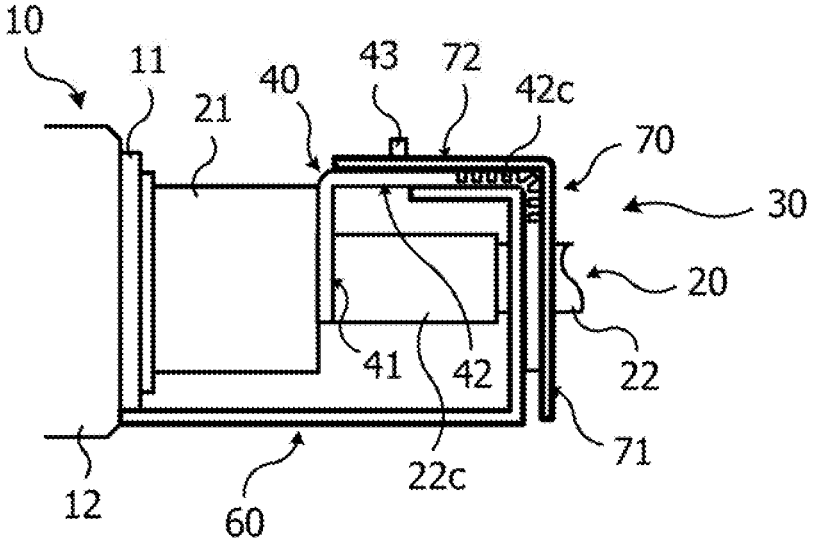
FIGS. 19A, 19B, and 19C are diagrams (part 5) to describe the fixing method using the cable fixture according to the second embodiment.
Figure 19B:
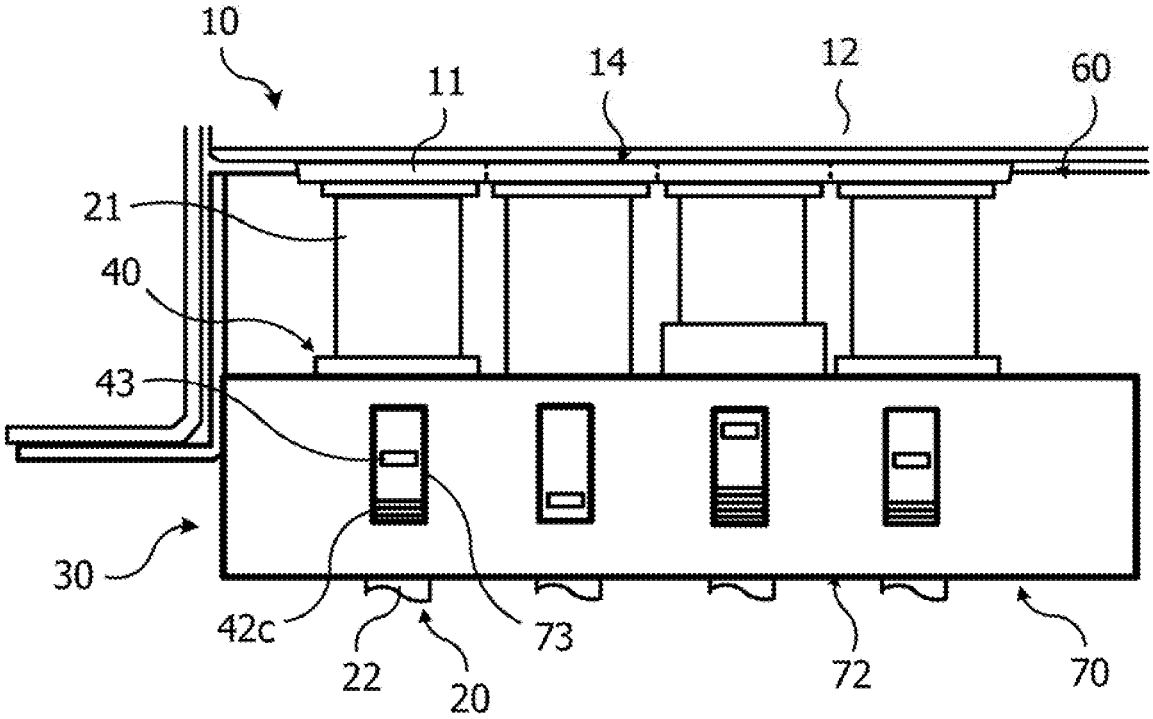
Figure 19C:
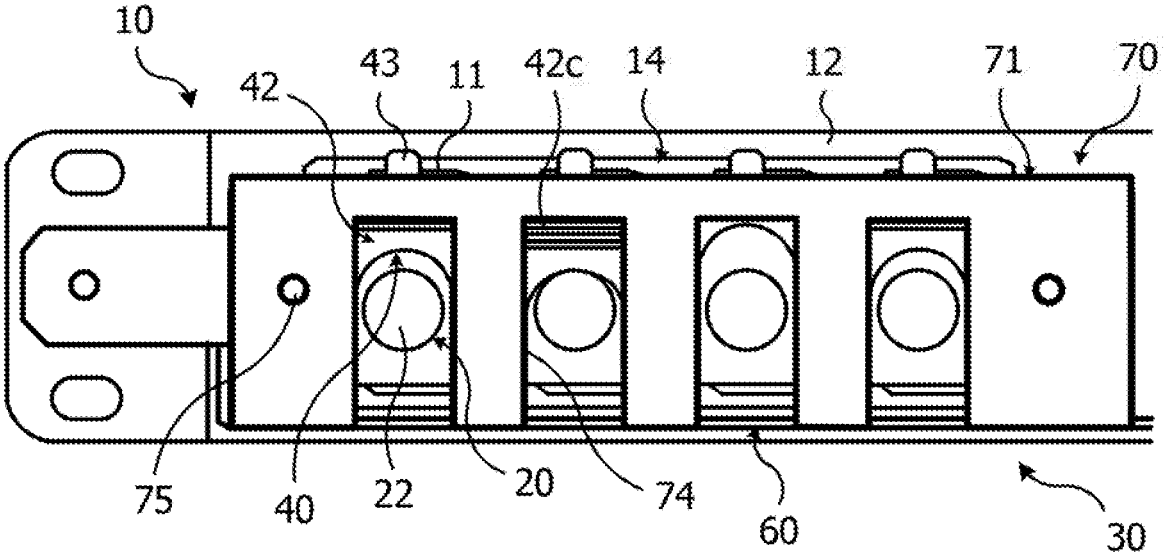

FIGS. 19A, 19B, and 19C are diagrams illustrating an exemplary state where the presser metal fitting is provided. FIG. 19A is a side view, FIG. 19B is a top view, and FIG. 19C is a front view.

FIGS. 19A to 19C focus on the block 14 among the above-described two blocks 14 and 15 of the PDU 10. In FIGS. 19A to 19C, illustration of the frame 81 of the rack 80 is omitted, and illustration of the side plate (FIG. 17A) of the fixing metal fitting 60 is omitted in FIG. 19A.

As illustrated in FIGS. 19A to 19C, the presser metal fitting 70 is provided on the pressers 40 provided on the fixing metal fitting 60. For the presser metal fitting 70, a presser metal fitting having the configuration as described above in FIGS. 14A to 14C is used. The presser metal fitting 70 includes: the plate portion 72; the plate portion 71 bent from the plate portion 72; the openings 73 corresponding to the knobs 43 of the respective pressers 40; the openings 74 through which the power cables 20 are made to pass respectively; the screw holes 75 to fix the presser metal fitting 70; and the spacer 76 having the thickness equivalent to the thickness of each of the pressers 40. Note that illustration of the spacer 76 is omitted in FIGS. 19A to 19C for convenience.

The presser metal fitting 70 is provided on the pressers 40 on the fixing metal fitting 60 such that the knobs 43 of the pressers 40 provided in a manner corresponding to the respective connectors 21 are exposed from the openings 73. The presser metal fitting 70 is fixed to the fixing metal fitting 60 by the screwing while using the screw holes 75 of the presser metal fitting 70 and the screw holes 65 of the fixing metal fitting 60 provided in a manner corresponding to the screw hole 75. In a case where the spacers 76 having the thickness same as or equivalent to the thickness of each of the pressers 40 is provided in the presser metal fitting 70, it may be possible to suppress: excessive fastening at the time of fixing the presser metal fitting 70 to the fixing metal fitting 60 by the screwing while sandwiching the pressers 40; and uneven load application due to the fastening places. Since the presser metal fitting 70 is fixed to the fixing metal fitting 60 by the screwing, the positions of the pressers 40 sandwiched between the presser metal fitting 70 and the fixing metal fitting 60 are fixed.

The presser metal fitting 70 is fixed to the fixing metal fitting 60 by the screwing in the state where the plate portions 41 of the pressers 40 are made to abut on the respective connectors 21. As a result, it may be possible to achieve the cable fixture 30 in which the respective connectors 21 are pressed to the respective outlets 11 side by the pressers 40. According to this cable fixture 30, movement of each connector 21 in the direction in which the connector 21 comes off from a corresponding outlet 11 is regulated by each presser 40, and the connector 21 is suppressed from coming off from the outlet 11. Since the plate portions 41 of the pressers 40 are made to abut on the connectors 21 in accordance with the respective sizes of the connectors 21 plugged into the respective outlets 11 before fixation by the screwing, the connector 21 of any size as illustrated in FIGS. 19A to 19C is suppressed from coming off by the cable fixture 30.

Here, an exemplary method of making (a plate portion 41) of each presser 40 abut on a connector 21 will be described.

Figure 20A:
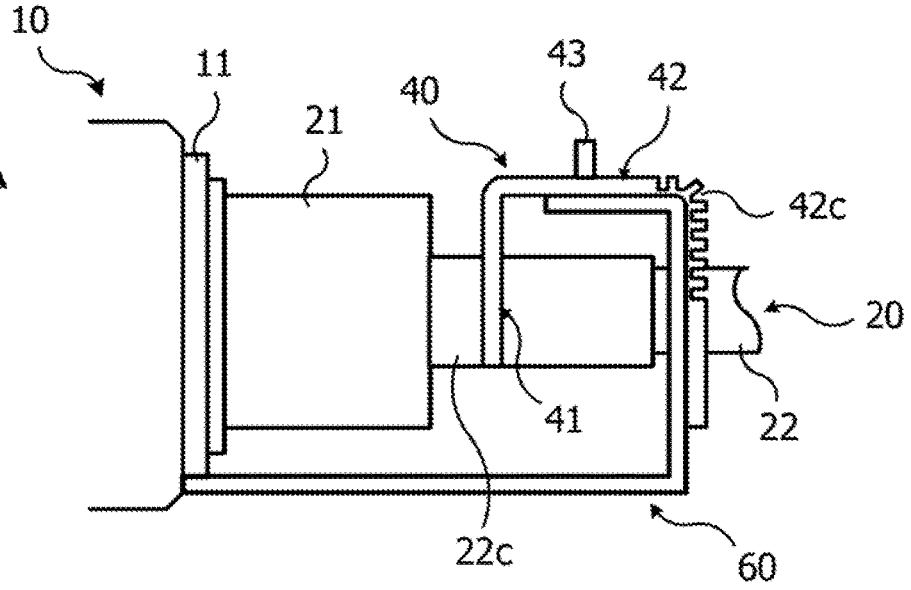
FIGS. 20A, 20B, and 20C are views (part 6) to describe the fixing method using the cable fixture according to the second embodiment.
Figure 20B:
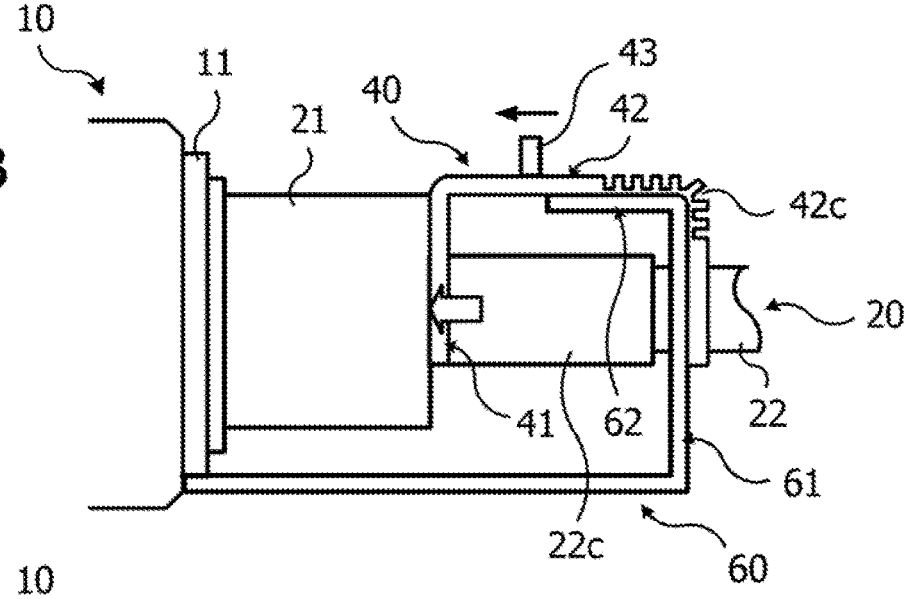
Figure 20C:
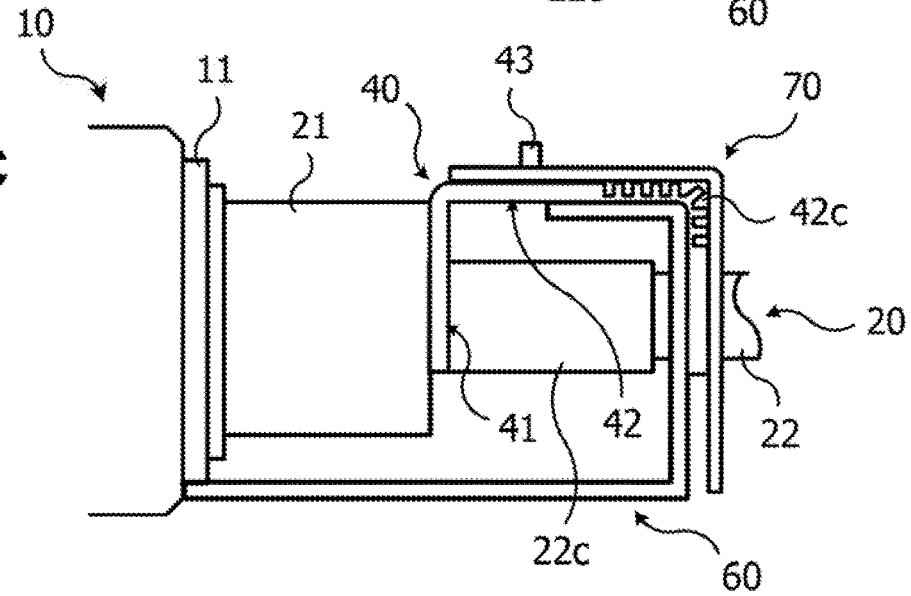

FIGS. 20A, 20B, and 20C are diagrams illustrating a first example of the method of making each presser abut on the connector. FIG. 20A schematically illustrates a side view of the main portion in an exemplary process of providing the presser on the fixing metal fitting. FIG. 20B schematically illustrates a side view of the main portion in an exemplary process of making the presser abut on the connector. FIG. 20C schematically illustrates a side view of the main portion in an exemplary process of fixing the presser metal fitting to the fixing metal fitting.

In this first example, each presser 40 is first provided on the fixing metal fitting 60 as illustrated in FIG. 20A from the state (FIG. 17A) of obtaining the PDU 10 in which the fixing metal fitting 60 is provided and the connectors 21 of the power cables 20 are plugged into the respective outlets 11 as described above. At this time, a plate portion 41 of each presser 40 provided on the fixing metal fitting 60 does not necessarily abut on the connectors 21. FIG. 20A illustrates, for example, the state where a plate portion 41 of each presser 40 is positioned separately from each connector 21.

From the state where the presser 40 is provided on the fixing metal fitting 60, the position of the presser 40 is adjusted so as to make the plate portion 41 abut on the connector 21 (the stepped portion from the root covered portion 22*c* of the electric wire portion 22) as illustrated in FIG. 20B. A knob 43 is used to adjust the position of each presser 40, and the plate portion 42 of the presser 40 is slid on the fixing metal fitting 60 by displacing the knob 43 in the facing direction between the presser 40 and the outlet 11. When the plate portion 42 is slid on the fixing metal fitting 60, the presser 40 is sequentially bent at respective cutout portions 42*c* each corresponding to a bent portion between the plate portion 62 and the plate portion 61 of the fixing metal fitting 60. A plate portion 41 of each presser 40 is displaced with the sliding movement of a plate portion 42 on the fixing metal fitting 60. For example, from the state as illustrated in FIG. 20A, the plate portion 42 of the presser 40 is slid on the fixing metal fitting 60 toward the connector 21 side by the knob 43 as illustrated in FIG. 20B. With this sliding movement, the plate portion 41 is displaced toward the connector 21 side, and the plate portion 41 abuts on the connector 21. Such abutment of a plate portion 41 is performed in accordance with a size of a connector 21 for every connector 21 plugged into an outlet 11 of the PDU 10.

Then, from the state where the plate portions 41 of the respective pressers 40 abut on the respective connectors 21, the presser metal fitting 70 is provided while exposing the knobs 43 from the respective openings 73 (FIGS. 19A to 19C and the like) on the respective pressers 40 on the fixing metal fitting 60 as illustrated in FIG. 20C. The presser metal fitting 70 is fixed to the fixing metal fitting 60 by the screwing. Since the presser metal fitting 70 is fixed to the fixing metal fitting 60 by the screwing, a plate portion 41 of each presser 40 is fixed at a position where the plate portion 41 abuts on each connector 21. Since the position of the presser 40 is thus fixed, the connector 21 is pressed to the outlet 11 side by the abutment of the plate portion 41 of the presser 40. Thus, each connector 21 is suppressed from coming off from each outlet 11.

For example, the method as described in the first example (FIGS. 20A to 20C) is used to adjust the position of each presser 40 and make a plate portion 41 of the presser 40 abut on the connector 21.

Figure 21A:
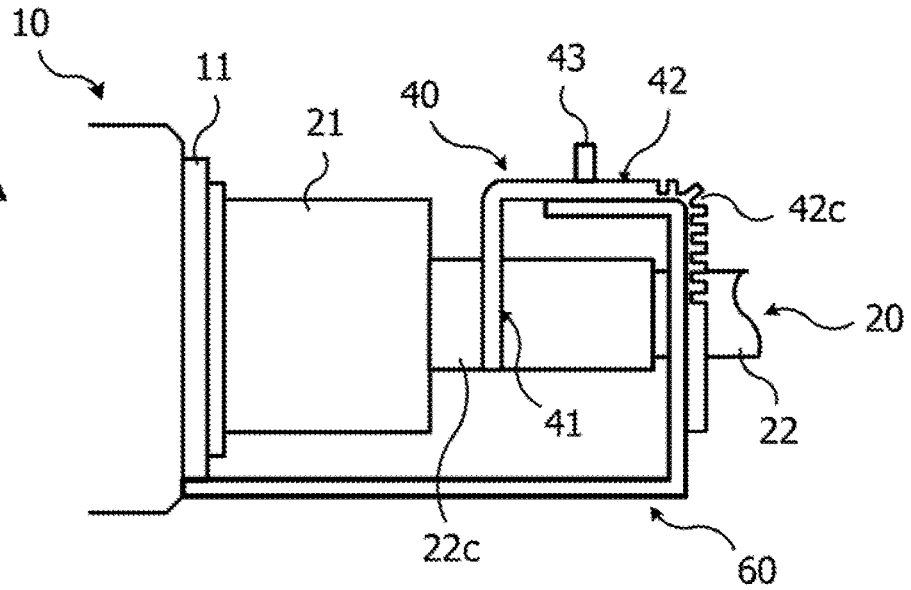
FIGS. 21A, 21B, and 21C are diagrams (part 7) to describe the fixing method using the cable fixture according to the second embodiment.
Figure 21B:
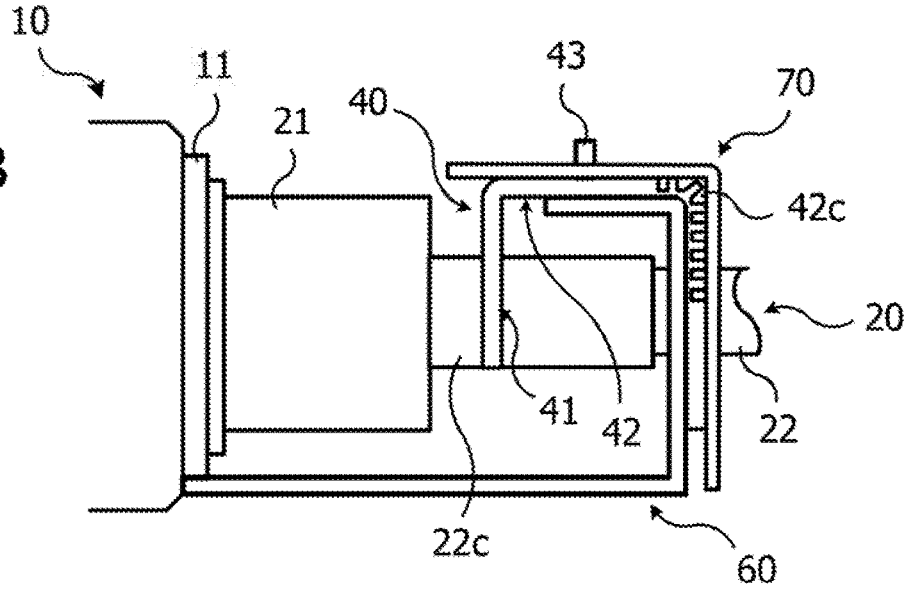
Figure 21C:
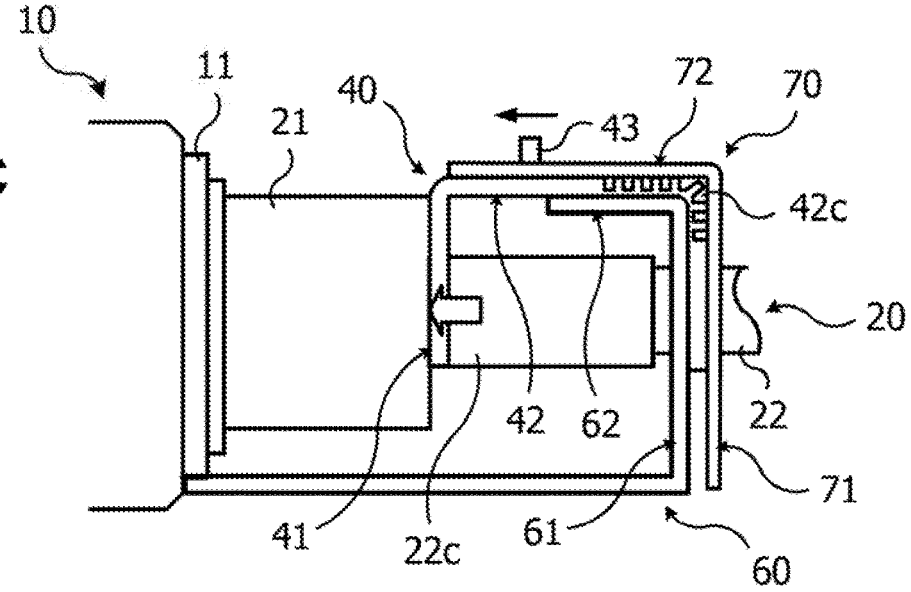

FIGS. 21A to 21C are diagrams to describe a second example of the method of making each presser abut on a connector. FIG. 21A schematically illustrates a side view of the main portion in an exemplary process of providing the presser on the fixing metal fitting. FIG. 21B schematically illustrates a side view of the main portion in an exemplary process of providing the presser metal fitting on the presser. FIG. 21C schematically illustrates a side view of the main portion in an exemplary process of making the presser abut on the connector.

In this second example, each presser 40 is first provided on the fixing metal fitting 60 as illustrated in FIG. 21A from the state (FIG. 17A) in which the connectors 21 of the power cables 20 are plugged into the outlets 11 of the PDU 10 provided with the fixing metal fitting 60. At this time, a plate portion 41 of each presser 40 provided on the fixing metal fitting 60 does not necessarily abut on the connectors 21. FIG. 21A illustrates, for example, the state where a plate portion 41 of each presser 40 is positioned separately from each connector 21.

From the state where the pressers 40 are provided on the fixing metal fitting 60, the presser metal fitting 70 is provided on the pressers 40 on the fixing metal fitting 60 as illustrated in FIG. 21B such that the knobs 43 are exposed from the respective openings 73 (FIGS. 19A to 19C and the like). At this time, the presser metal fitting 70 is provided on the pressers 40 such that the pressers 40 sandwiched between the presser metal fitting 70 and the fixing metal fitting 60 may be slid by the respective knobs 43. For example, the presser metal fitting 70 is temporarily fixed to the fixing metal fitting 60 by screws or the like in a state where the pressers 40 are sandwiched between the presser metal fitting 70 and the fixing metal fitting 60. Alternatively, the presser metal fitting 70 may be provided in a state simply placed on the pressers 40.

From the state where the presser metal fitting 70 is provided on the pressers 40 on the fixing metal fitting 60, a position of each of the pressers 40 is adjusted, and a plate portion 41 of the presser 40 abuts on each connector 21 (a stepped portion from the root covered portion 22*c* of the electric wire portion 22) as illustrated in FIG. 21C. A knob 43 is used to adjust a position of each presser 40, and a plate portion 42 of each presser 40 is slid between the fixing metal fitting 60 and the presser metal fitting 70 by displacing the knob 43 in the facing direction between the presser 40 and the outlet 11. When the plate portion 42 is slid between the fixing metal fitting 60 and the presser metal fitting 70, the presser 40 is sequentially bent at places of cutout portions 42*c* each corresponding to a bent portion between the plate portion 62 and the plate portion 61 of the fixing metal fitting 60 and a bent portion between the plate portion 72 and the plate portion 71 of the presser metal fitting 70. A plate portion 41 of each presser 40 is displaced with the sliding movement of a plate portion 42 between the fixing metal fitting 60 and the presser metal fitting 70. For example, from the state illustrated in FIG. 21B, a plate portion 42 of each presser 40 is slid toward a connector 21 side between the fixing metal fitting 60 and the presser metal fitting 70 by a knob 43 as illustrated in FIG. 21C. With this sliding movement, the plate portion 41 of the presser 40 is displaced to the connector 21 side, and the plate portion 41 abuts on the connector 21. Such abutment of a plate portion 41 is performed in accordance with a size of a connector 21 for every connector 21 plugged into an outlet 11 of the PDU 10.

Then, from the state where a plate portion 41 of each presser 40 abuts on a connector 21, the presser metal fitting 70 is fixed to the fixing metal fitting 60 by the screwing in a manner similar to the above-described method. Since the presser metal fitting 70 is fixed to the fixing metal fitting 60 by the screwing, a plate portion 41 of each presser 40 is fixed at a position where the plate portion 41 abuts on each connector 21. Since the position of the presser 40 is thus fixed, the connector 21 is pressed to the outlet 11 side by the abutment of the plate portion 41 of the presser 40. Thus, each connector 21 is suppressed from coming off from each outlet 11.

For example, the method as illustrated in the second example (FIGS. 21A to 21C) is used to adjust the position of the presser 40 and make the plate portion 41 abut on the connector 21.

Here, the description has been provided for the exemplary methods in which a plate portion 42 of each presser 40 is slide along the plate portion 62 of the fixing metal fitting 60 (first example) or along the plate portion 62 of the temporarily-fixed fixing metal fitting 60 and the plate portion 72 of the presser metal fitting 70 (second example) before fixing the presser metal fitting 70 to the fixing metal fitting 60 by the screwing. Besides, in a case where a presser 40 bent at a place of a cutout portion 42*c* keeps a bent shape of the presser 40, the presser 40 may be preliminarily adjusted to a size of a connector 21 before being provided on the fixing metal fitting 60, and then the presser 40 may be bent at a cutout portion 42*c* where a plate portion 41 abuts on the connector 21. Since the pressers 40 thus bent in advance are provided on the fixing metal fitting 60, and the presser metal fitting 70 is provided on the pressers 40, and then the presser metal fitting 70 is fixed to the fixing metal fitting 60 by the screwing, it may be possible to achieve a structure in which connectors 21 are pressed to outlets 11 side by the pressers 40, respectively.

As described above, according to the cable fixture 30 according to the second embodiment, the pressers 40 are fixed by the fixing metal fitting 60 and the presser metal fitting 70 in the state where the plate portions 41 of the pressers 40 abut on the respective connectors 21 of the power cables 20 plugged into the corresponding outlets 11 of the PDU 10. As a result, each connector 21 is pressed to each outlet 11 side by each presser 40, and the connector 21 is suppressed from coming off from the outlet 11. Since each connector 21 is suppressed from coming off from each outlet 11, power failure of another electronic device that receives power supply from the PDU 10 via the power cable 20 is suppressed.

In the cable fixture 30, a position of each presser 40 may be adjusted in accordance with a size of each connector 21, and a plate portion 41 of each presser 40 abuts on a connector 21 of any size. Thus, each connector 21 is suppressed from coming off from each outlet 11, and the power failure caused by the coming-off of the connector 21 is suppressed. Thus, since the cable fixture 30 is adaptable to a connector 21 of any size, a type of a power cable 20 used in the PDU 10 may not be limited by the size of each connector 21. Even in a case of using power cables 20 respectively having connectors 21 having different sizes, it may be possible to avoid preparing fixtures for (connectors 21) of respective power cables 20 and installing these fixtures in (the connectors 21) of the respective power cables 20. In the cable fixture 30, it may not be desired to change arrangement of a plurality of outlets 11 in the PDU 10, for example, not desired to broaden a pitch between the outlets like the case of providing a cable clamp. Therefore, it may be possible to avoid reducing the number of outlets 11 of the PDU 10 and reducing the number of connectable electronic devices. Alternatively, it may be possible to avoid upsizing the PDU 10 and reducing the number of electronic devices mountable on the rack 80. In the cable fixture 30, even in a case where the plurality of outlets 11 is provided in parallel at a narrow pitch, the connectors 21 to be plugged into the respective outlets may be pressed by the respective pressers 40 in accordance with the respective sizes of the connectors 21. Thus, a connector 21 of any size may be suppressed from coming off from an outlet 11.

In the description of the second embodiment, the description has been provided for the example in which the cable fixture 30 is applied to the connectors 21 of the power cables 20 connected to the outlets 11 of the PDU 10. Besides, not limited to the PDU 10, the cable fixture 30 may be applicable to: a connector 21 of a power cable 20 connected to an outlet of an electronic device from which the PDU 10 receives power supply; and connectors of power cables connected to outlets of other various kinds of electronic devices. The cable fixture 30 may be applicable to not only to a connector 21 of a power cable 20 but also to connectors of various kinds of cables connected to outlets of various kinds of electronic devices.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A cable fixture comprising:

a first pressing member including:

a first plate portion facing a first outlet and a first connector of a first cable plugged into the first outlet, and a second plate portion bent from the first plate portion to one side in a facing direction between the first plate portion and the first outlet; and a supporting member configured to support the first pressing member and capable of fixing the second plate portion at a position where the first plate portion abuts on the first connector, the supporting member includes:

a first supporting tool provided on one surface side of the second plate portion; and a second supporting tool provided on another surface side of the second plate portion, the first pressing member has the second plate portion sandwiched between the first supporting tool and the second supporting tool, the first supporting tool includes:

a third plate portion extending in a first direction in which the first plate portion is away from the first connector, the first direction being included in the facing direction; and a fourth plate portion bent at an end in the first direction of the third plate portion and facing the first plate portion, the second supporting tool includes:

a fifth plate portion extending in the first direction; and a sixth plate portion bent at an end in the first direction of the fifth plate portion and facing the first plate portion, the second plate portion includes:

a first region extending from the first plate portion in the first direction and sandwiched between the third plate portion and the fifth plate portion; and a second region bent from the first region and sandwiched between the fourth plate portion and the sixth plate portion.

2. The cable fixture according to claim 1, wherein the supporting member slidably supports the second plate portion in the facing direction while the second plate portion is unfixed.

3. The cable fixture according to claim 1, wherein the second plate portion includes a bent portion bendable at one place of an area sandwiched between the first supporting tool and the second supporting tool, the first region corresponds to one side of the one place where the second plate portion is bent, and the second region corresponds to another side different from the one side of the one place where the second plate portion is bent.

4. The cable fixture according to claim 3, wherein the bent portion includes a plurality of cutout portions provided on a surface layer of the second plate portion and extending in a second direction orthogonal to a direction in which the second plate portion is bent, and each of the plurality of cutout portions is bendable as the one place where the second plate portion is bent.

5. The cable fixture according to claim 3, wherein the first plate portion is adjusted to a position where the first plate portion abuts on the first connector, by adjusting the one place where the second plate portion is bent.

6. The cable fixture according to claim 3, wherein the second supporting tool includes an opening provided on the fifth plate portion, and the first pressing member includes a knob provided on the second plate portion, exposed from the opening, and used to adjust the one place where the second plate portion is bent.

7. The cable fixture according to claim 1, further comprising a second pressing member that includes:

a seventh plate portion facing a second outlet provided in parallel with the first outlet, and a second connector of a second cable plugged into the second outlet; and an eighth plate portion bent from the seventh plate portion in the one side in the facing direction, wherein the supporting member is configured to support the first pressing member and is capable of fixing the second plate portion at a position where the first plate portion abuts on the first connector, and the supporting member is configured to support the second pressing member and is capable of fixing the eighth plate portion at a position where the seventh plate portion abuts on the second connector.

8. An electronic device comprising:

a first outlet;

a first cable having a first connector plugged into the first outlet; and a cable fixture configured to fix the first cable, the cable fixture includes:

a first pressing member including:

a first plate portion facing the first outlet and the first connector of the first cable plugged into the first outlet, and a second plate portion bent from the first plate portion to one side in a facing direction between the first plate portion and the first outlet; and a supporting member configured to support the first pressing member and capable of fixing the second plate portion at a position where the first plate portion abuts on the first connector, the supporting member includes:

a first supporting tool provided on one surface side of the second plate portion; and a second supporting tool provided on another surface side of the second plate portion, the first pressing member has the second plate portion sandwiched between the first supporting tool and the second supporting tool, the first supporting tool includes:

a third plate portion extending in a first direction in which the first plate portion is away from the first connector, the first direction being included in the facing direction; and a fourth plate portion bent at an end in the first direction of the third plate portion and facing the first plate portion, the second supporting tool includes:

a fifth plate portion extending in the first direction; and a sixth plate portion bent at an end in the first direction of the fifth plate portion and facing the first plate portion, the second plate portion includes:

a first region extending from the first plate portion in the first direction and sandwiched between the third plate portion and the fifth plate portion; and a second region bent from the first region and sandwiched between the fourth plate portion and the sixth plate portion.

9. The electronic device according to claim 8, wherein the supporting member slidably supports the second plate portion in the facing direction while the second plate portion is unfixed.

10. The electronic device according to claim 8, wherein the second plate portion includes a bent portion bendable at one place of an area sandwiched between the first supporting tool and the second supporting tool, the first region corresponds to one side of the one place where the second plate portion is bent, and the second region corresponds to another side different from the one side of the one place where the second plate portion is bent.

* * * * *